US011596990B2

(12) United States Patent
Fu

(10) Patent No.: US 11,596,990 B2
(45) Date of Patent: Mar. 7, 2023

(54) STEEL-PLATE DESCALING DEVICE

(71) Applicant: ZHEJIANG MOPPER ENVIRONMENTAL TECHNOLOGY CO., LTD, Zhejiang (CN)

(72) Inventor: Ruxue Fu, Zhejiang (CN)

(73) Assignee: ZHEJIANG MOPPER ENVIRONMENTAL TECHNOLOGY CO., LTD, Zhejiang (CN)

( * ) Notice: Subject to any disclaimer, the term of this patent is extended or adjusted under 35 U.S.C. 154(b) by 269 days.

(21) Appl. No.: 17/037,718

(22) Filed: Sep. 30, 2020

(65) Prior Publication Data

US 2021/0101195 A1 Apr. 8, 2021

(30) Foreign Application Priority Data

Oct. 7, 2019 (CN) ..... 201910947017.0

(51) Int. Cl.
*B21B 45/04* (2006.01)
*B24B 27/033* (2006.01)
*B24B 41/02* (2006.01)

(52) U.S. Cl.
CPC ..... *B21B 45/04* (2013.01); *B24B 27/033* (2013.01); *B24B 41/02* (2013.01); *B21B 2203/18* (2013.01); *B21B 2203/26* (2013.01)

(58) Field of Classification Search
CPC ..... B21B 31/08; B21B 31/10; B21B 31/103; B21B 45/04; B21B 45/06; B24B 27/033
USPC ..... 29/81.03, 81.11
See application file for complete search history.

(56) References Cited

FOREIGN PATENT DOCUMENTS

CN 205129580 U * 4/2016
JP 03207879 A * 9/1991

OTHER PUBLICATIONS

Chen, Translation of CN-205129580 (Year: 2016).*
Ishizono, Translation of JPH03207879 (Year: 1991).*

* cited by examiner

*Primary Examiner* — Shelley M Self
*Assistant Examiner* — Bobby Yeonjin Kim
(74) *Attorney, Agent, or Firm* — JCIP Global Inc.

(57) ABSTRACT

The invention relates to a steel-plate descaling device, including several steel-plate surface descalers and several steel-plate side-surface descalers disposed along the direction of a flow line as well as a trolley rail disposed in parallel to one side of the flow line. At least one roller-changing vehicle slides back and forth on the rail. The roller-changing vehicle is provided with a roller-changing mechanism. When the roller-changing vehicle slides to a front side of the steel-plate surface descaler, the roller-changing mechanism extends into the inner part of the steel-plate surface descaler to change the roller. The oxide scale of the steel-plate surface is removed physically, having low pollution and high descaling efficiency without a blind spot, and simultaneously having a high degree of automation in replacing the descaling roller through the roller-changing vehicle, saving both time and effort.

19 Claims, 24 Drawing Sheets

STEEL-PLATE DESCALING DEVICE

CROSS-REFERENCE TO RELATED APPLICATION

This application claims the priority benefit of China application serial no. 201910947017.0, filed on Oct. 7, 2019. The entirety of the above-mentioned patent application is hereby incorporated by reference herein and made a part of this specification.

BACKGROUND

Technical Field

The invention relates to the technical field of metal surface treatment, in particular to a steel-plate descaling device.

Description of Related Art

It usually takes a while for steel plates to be put into actual use after production. During this period of time, the surfaces of the steel plates may rust for various reasons, affecting the actual use. Therefore, before being used, the rusted surfaces of the steel plates need to be subjected to a descaling treatment.

Currently, it is common to remove oxide scales from the surfaces of the steel plates (i.e., descaling) by performing a pickling process. The principle of the prickling process is to use acid in a pickling solution to chemically react with metal oxide and thereby dissolve the metal oxide and remove the rust and dirt on the surface of a steel material. However, the steel plates need to be washed wish a certain amount of clean water and further require a passivation process after the descaling process using the pickling solution. The significant amount of waste water, waste acid, and acid mist produced thus contaminate the environment. If the processes are not carried out properly, the metal may be over-corroded to form pitting marks on the surface. Considering the increasing severity of smog and water and soil pollution across the country, as well as the increasing public awareness for environmental protection, the government is more and more determined to fight against pollution. For companies that still use pickling for removal of oxide scales, such measures are causing increasing pressure and forcing them to take environmental protection seriously. Thus, it is imminent to opt for a novel, environmental friendly descaling device. Of course, it is possible to physically remove oxide scales. A descaling mechanical device using a disk brush or an abrasive belt is commonly adopted in the conventional steel-plate descaling device. However, on one hand, such descaling device have poor descaling quality and low, incomprehensive descaling efficiency in practice; on the other hand, when the disc brush or the abrasive belt are worn off and are in need of replacement, to replace them manually is both time-consuming and laborious.

SUMMARY

To solve the above technical issue, the objective of the invention is to provide a low-pollution steel-plate descaling device capable of efficiently removing oxide scales from steel plates without a blind spot and replacing the descaling rollers automatically at a high degree.

For the above objective, the invention adopts the following technical solution.

A steel-plate descaling device is provided. The steel-plate descaling device includes one or more steel-plate surface descalers and one or more steel-plate side-surface descalers which are disposed along the device moving direction as well as a trolley rail disposed in parallel to one side of the device. At least one roller-changing vehicle is disposed on the trolley rail to be slid back and forth. The roller-changing vehicle is provided with a roller-changing mechanism. When the roller-changing mechanism travels to a front side of the steel-plate surface descaler, the roller-changing mechanism extends into the inner part of the steel-plate surface descaler to change the roller.

The oxide scale of the steel-plate surface is removed physically, having low pollution and high descaling efficiency without a blind spot, and simultaneously having a high degree of automation in replacing the descaling roller through the roller-changing vehicle, saving both time and effort.

Compared with the conventional art, the invention has the following beneficial effects:

1. By removing physically the oxide scale from the steel-plate surface, it has low pollution and high descaling efficiency without a blind spot, and simultaneously having a high degree of automation in replacing the descaling roller through a roller-changing vehicle from a steel-plate surface descaler, saving both time and effort.

2. By providing a roller-clamping mechanism on the steel-plate surface descaler, the stability of the steel plate is ensured during the surface descaling process of the steel plate, such that the descaling process maintains stable. By disposing one of the duo-rollers to be liftable and fixed, the roller-clamping mechanism may adapt to steel plates of different thicknesses.

3. The structure configuration of the U-shaped holes on the side plates and the roller-changing rails located on both sides of the U-shaped holes enables the roller-changing mechanism to extend into the steel-plate surface descaler to change the descaling roller.

4. The lifting motor drives the angle adjuster and rotates the connecting shaft, driving the lifting mechanism to operate, and the lifting mechanism at last drives the chief operating bean to move in the vertical direction, realizing the lifting of the descaling roller. By providing the first linear slide rail and the first linear slider, the upper beam disposed on the first linear slider may move back and forth on the first linear slide rail. And the effective length (referring to the part effective of descaling) of the descaling roller is longer than the width of the steel plate. The configuration of the descaling roller moving back and forth along with the upper beam increases the utilization efficiency and prolongs the service life of the descaling roller.

5. The upper beam and one of the bearing bases are provided to be movable, such that the bearing bases on the both ends of the descaling roller may disengage from or fit with the descaling roller, realizing the automatic removal and replacement of the descaling roller and improving the efficiency and saving manpower, thereby implementing the automation.

6. By engaging and sleeving the gear shaft with the inner gear, the two are fixed in the circumferential direction and movable in the axial direction. During the installation of the descaling roller, the both ends of the descaling roller are firstly inserted into the gear shafts, and the outer gears at both ends of the descaling roller abut against the front end surfaces of the inner gears. The rotation of the inner gears makes the teeth of the outer gears align with the gaps between the teeth of the inner gears. The translation motion of the inner gears is reversely pushed to generate elastic force so that the inner gears and the outer gears are sleeves together to realize the power connection between the two.

7. The roller-changing vehicle has two operating positions, that is, two movable roller-guiding seats and a roller-changing support device disposed on each roller-guiding seat. In specific applications, one is empty and the other is loaded with a new descaling roller. The overall movement of the roller-changing vehicle is convenient for the corresponding roller-guiding seat to align with the roller-changing entrance of the descaler, and the roller-guiding seat and the roller-changing support device may move respectively to form a secondary relay. The movement of the roller-guiding seat is convenient to approach the roller-changing entrance, while the roller-changing support device may move away from the roller-guiding seat and enter the descaler to send or receive the descaling rollers. The two roller-guiding seats operate alternately to complete the roller receiving and sending operations without manual intervention, thereby improving operation efficiency and use safety.

8. The side-brush descaling roller operates the descaling on the side surfaces of the steel plate. When the abrasive steel plate on the surface of the descaling roller is worn off to a certain degree, causing the descaling of the side surface of the steel plate to be ineffective, the guide-wheel driving mechanism drives the guide wheel to move outward. Under the operation of the roller-seat cylinder, the operating-roller seat moves inward until the abrasive steel plate on the surface of the descaling roller again comes into close contact with the side surface of the steel plate. The outward movement of the guide wheel and the inward movement of the operating-roller seat are synchronized, and the guide wheel is kept at all times in the state of clamping both sides of the steel plate. And such automatic adjustment enables the descaling roller to perform the descaling effectively at all times.

DESCRIPTION OF THE EMBODIMENTS

A descaling-roller changing vehicle of the present embodiment is an important part of a descaling device. The descaling device may be a steel-plate descaling device or a steel-wire descaling device. Whatever type of the device, a descaling roller is provided to brush off rust or oxide scale. A steel-plate descaling device is taken as an example to introduce the invention in detail.

In the present embodiment, a steel plate is provided as the reference. The moving direction of the steel plate with regard to the device is defined to be forward, and its opposite direction is the backward. The left and right sides of the moving direction of the steel plate are defined to be the left and the right, whereas the vertical direction is defined to be up and down. It is upon this basis that the orientations such as top, upper part, upper end, bottom, lower part, lower end, left side, and right side are defined. In the present embodiment, the roller adapted for descaling the surface of the steel plate is termed a "descaling roller". For example, the descaling roller of the present embodiment may adopt the descaling roller disclosed in the P.R.C. Patent Application No. CN201720567999.7.

Brush strips composed of a resin matrix are densely disposed on the descaling roller. And rigid abrasive particles, for example selecting from any one of diamond, silica, alumina, brown corundum, or microcrystalline fused alumina, are disposed in the strip structure of the resin matrix. By rotating the descaling roller, the brush strips brush and wear the steel plate. As the brush strips are consumed, the abrasive particles contact the surface of the steel plate to polish and remove the oxide scale.

Figure 1:
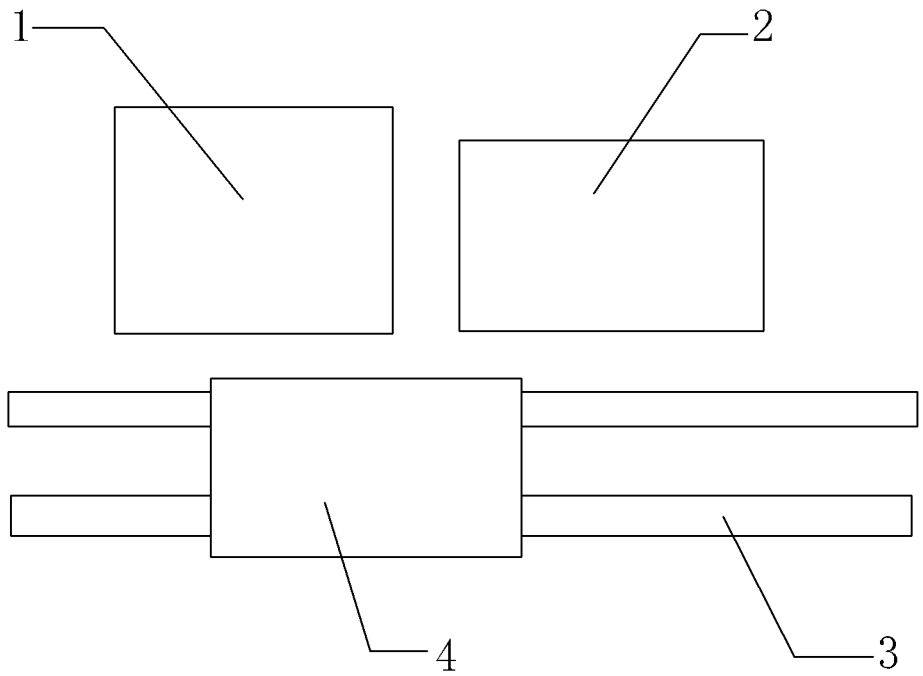
FIG. 1 is a block diagram of a steel-plate descaling device.
Figure 2:
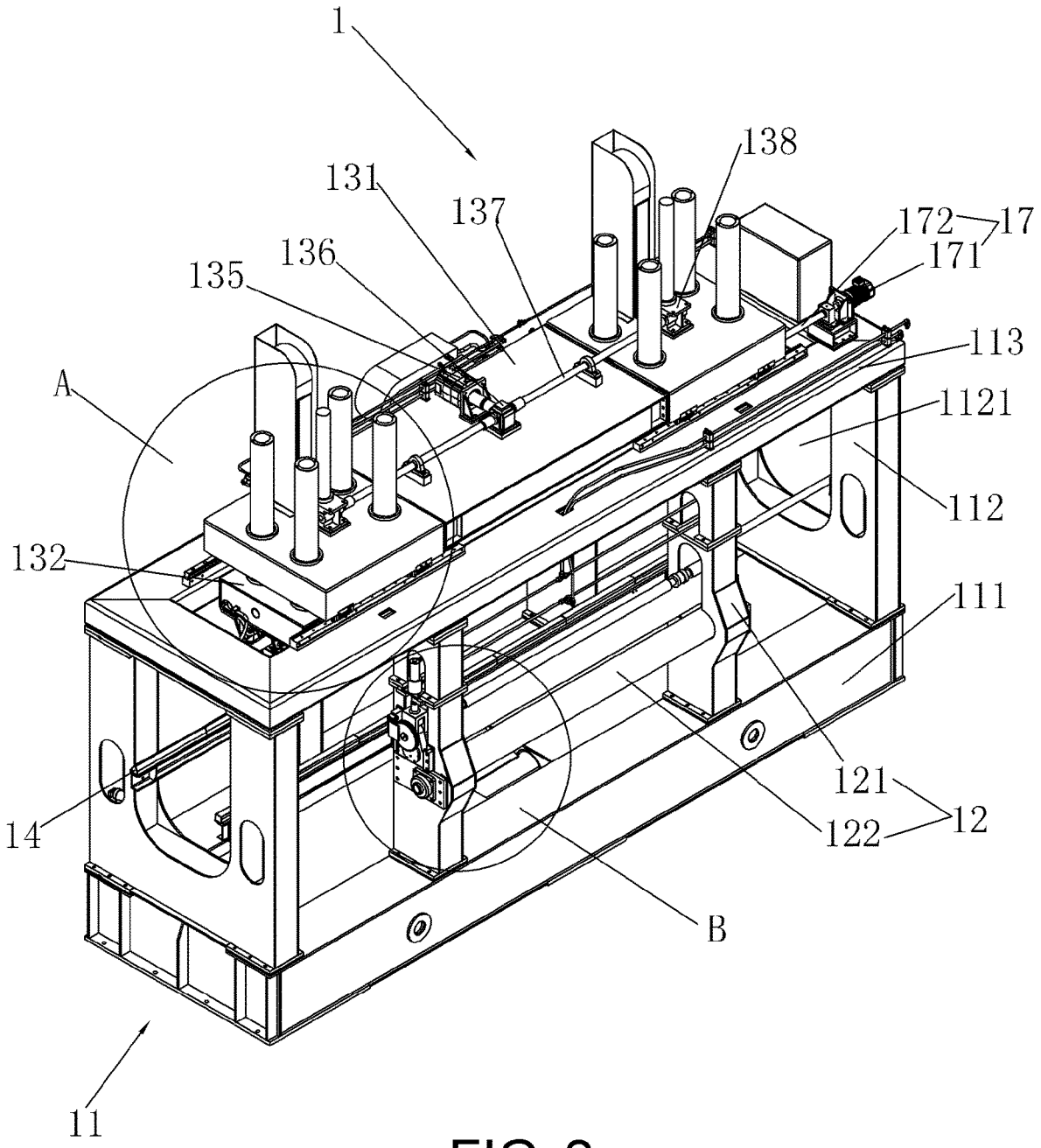
FIG. 2 is the first structural schematic view of the steel-plate surface descaler.
Figure 3:
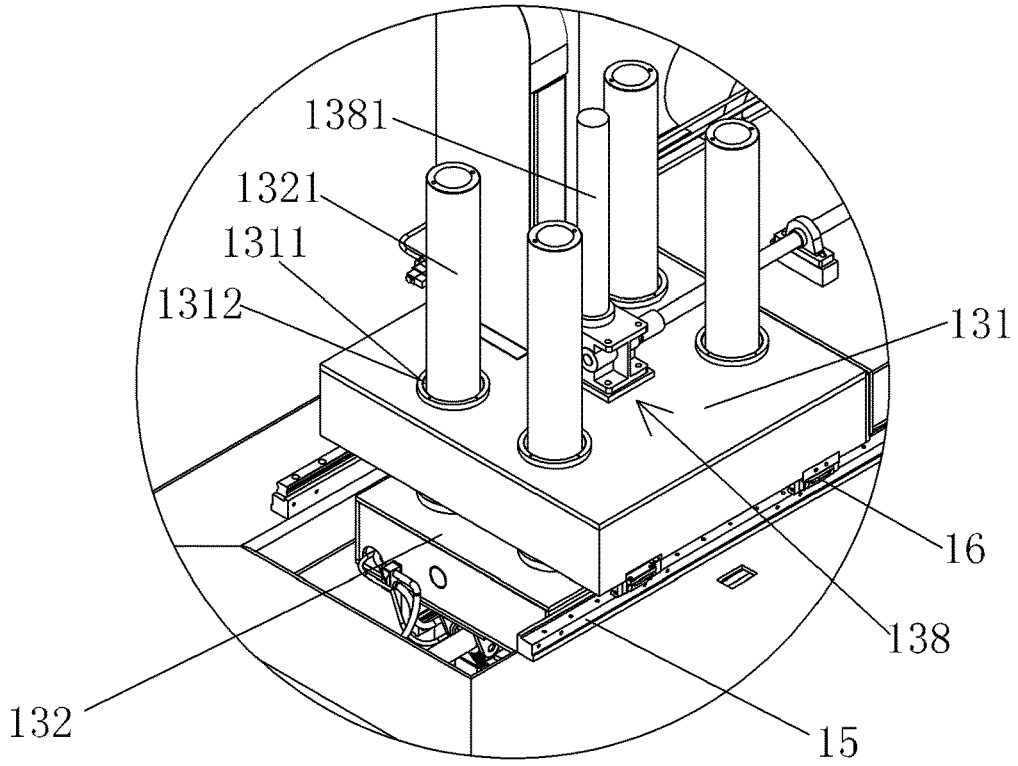
FIG. 3 is a partially enlarged diagram of the area A shown in FIG. 2.

The steel-plate descaling device shown in FIG. 1 includes a plurality of steel-plate surface descalers 1 and a plurality of steel-plate side-surface descalers 2 disposed in the moving direction of the device as well as a trolley rail 3 disposed in parallel to one side of the device. A roller-changing vehicle 4 is disposed on the trolley rail 3 to be slid back and forth on the rail. Some of the steel-plate surface descalers 1 adapted to treat rust on the upper surface of the steel plate are termed the steel-plate upper-surface descalers, and the others adapted to treat rust on the lower surface of the steel plate are termed the steel-plate lower-surface descalers. Theoretically, the steel-plate surface descalers 1 and the steel-plate side-surface descalers 2 may be disposed arbitrarily to achieve a comprehensive descaling effect on the steel plate. However, for the convenience of maintenance, the steel-plate upper-surface descalers are gathered together as one group, the steel-plate lower-surface descalers are gathered together as one group, the steel-plate side-surface descalers are gathered together as one group, and the side-surface descaler 2 is disposed between the steel-plate lower-surface descalers.

As shown in FIG. 2 and FIG. 5 to FIG. 8, the steel-plate surface descaler 1 includes a first frame 11, a roller-clamping mechanism 12, and a liftable descaling mechanism 13. The liftable descaling mechanism 13 is disposed on an upper part of the first frame 11 for descaling the surface of the steel plate. The roller-clamping mechanism 12 is arranged on a side of the first frame 11 below the liftable descaling mechanism 13. And the roller-clamping mechanism 12 is arranged to face the traveling direction of the steel plate, restricting the vertical movement of the steel plate. The first frame 11 includes a base 111, side plates 112 provided on the left and right sides of the base 111, and an upper bracket 113 opposite to the base 111. A U-shaped hole 1121 is provided on the side plate 112, and the U-shaped hole 1121 may also be termed a roller-changing entrance; the upper bracket 113 is fixed by the surrounding steel beams, and the liftable descaling mechanism 13 is disposed at a center of the upper bracket 113. Roller-changing rails 14 are arranged between the two U-shaped holes 1121 which are facing each other. The roller-changing rails 14 are disposed symmetrically. And the descaling roller 134 is arranged above the two roller-changing rails 14.

Figure 4:
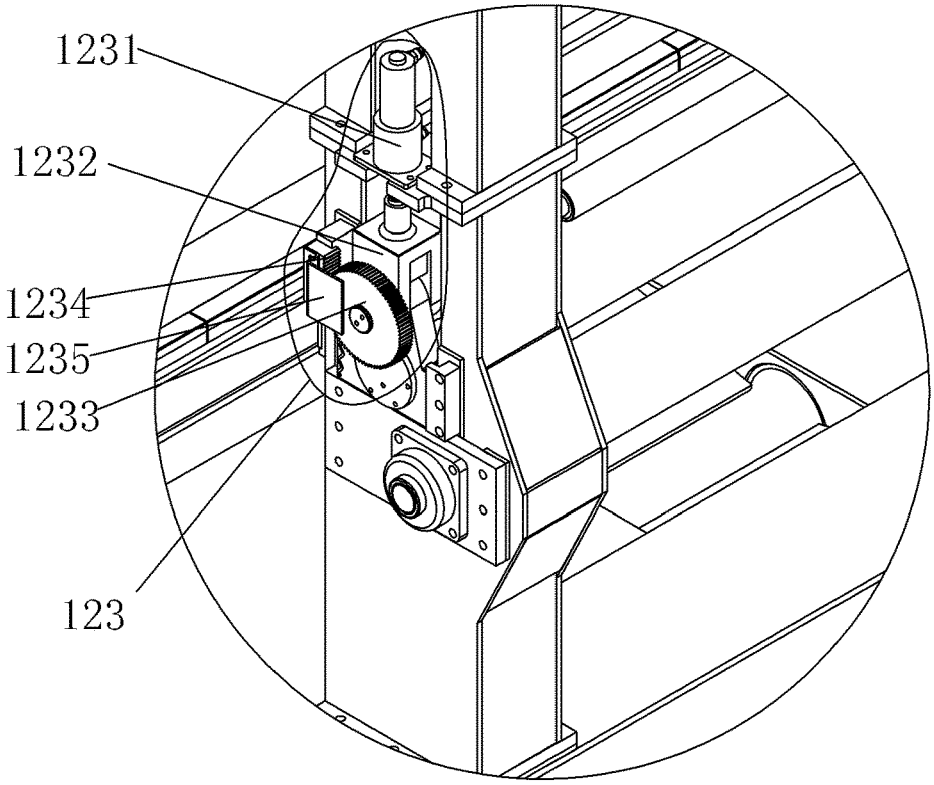
FIG. 4 is a partially enlarged diagram of the area B shown in FIG. 2.
Figure 5:
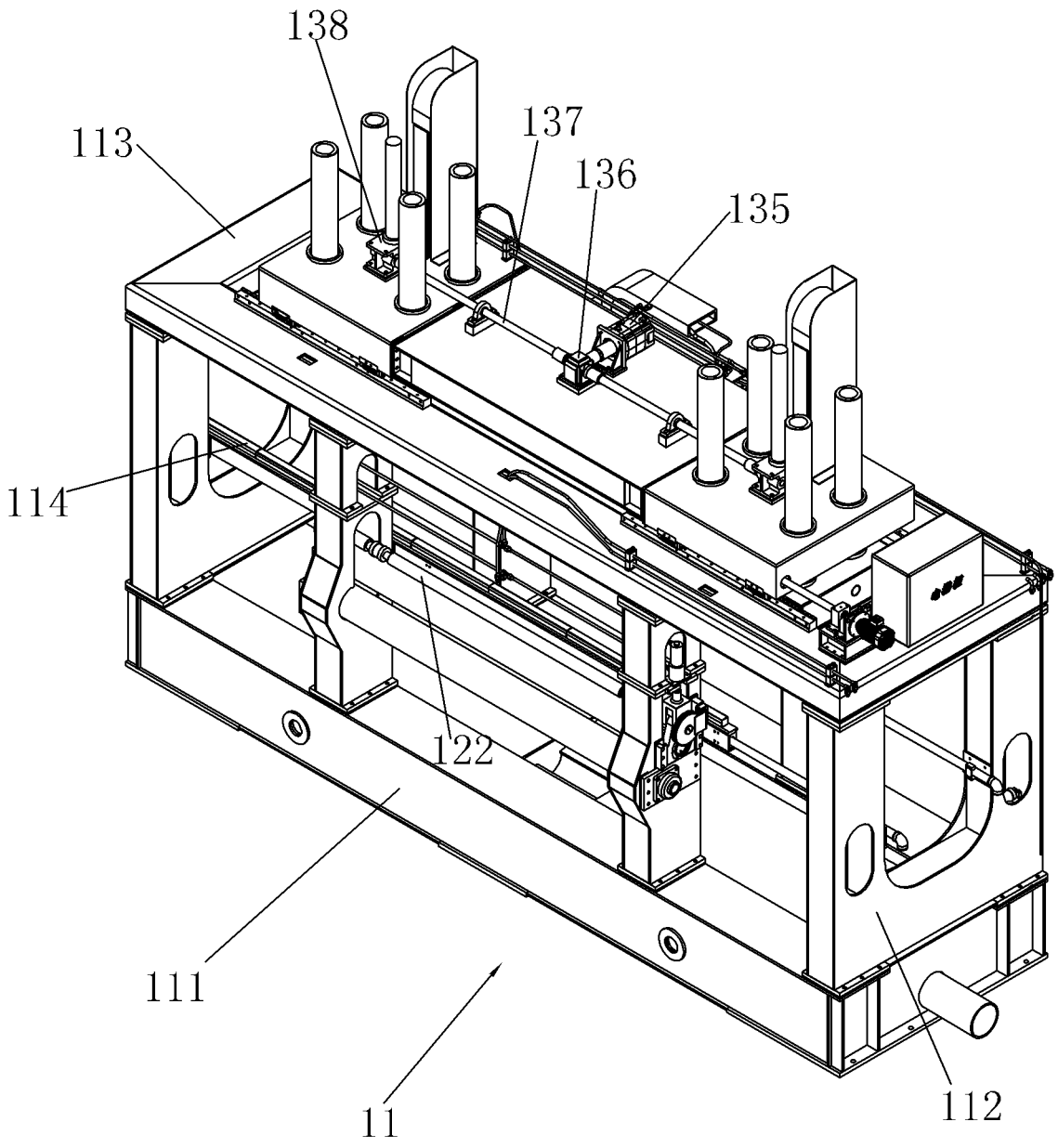
FIG. 5 is the second structural schematic view of the steel-plate surface descaler.
Figure 6:
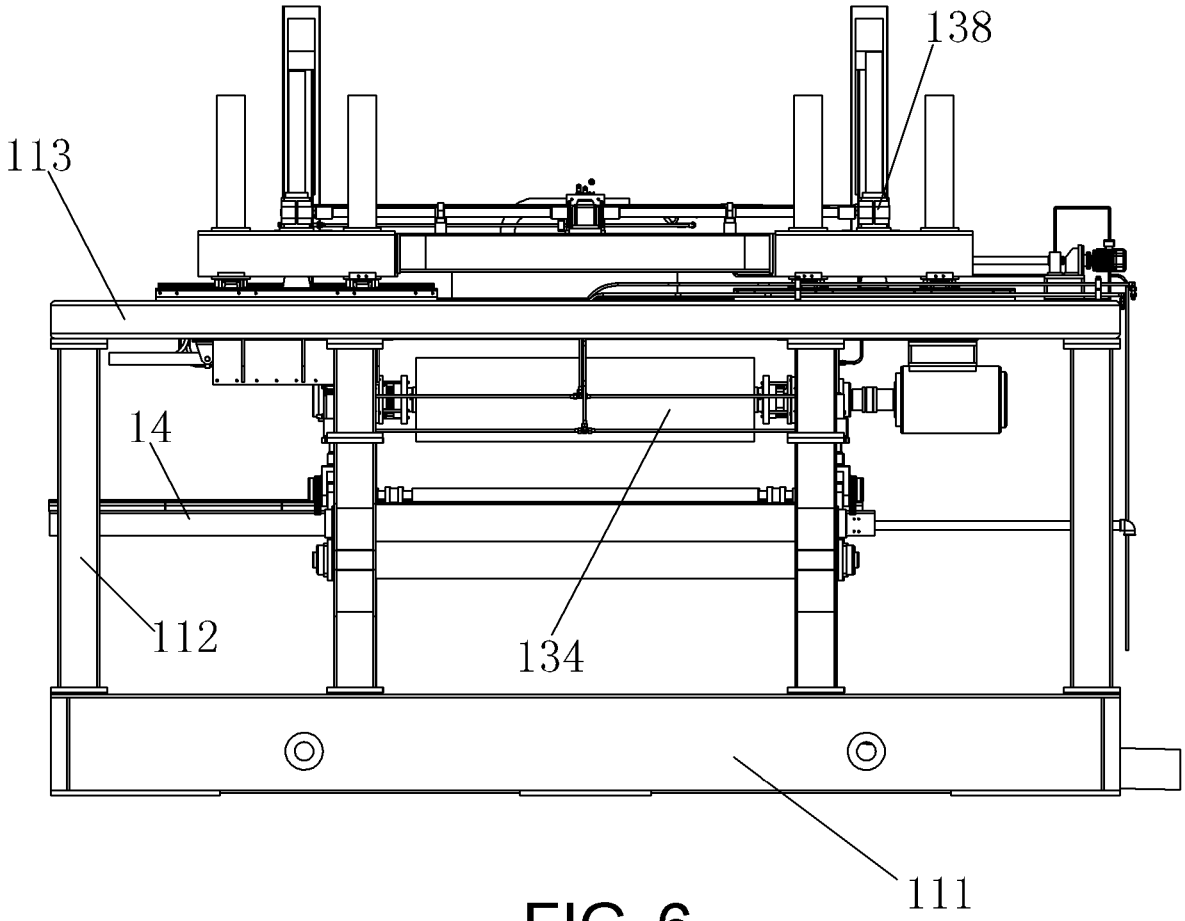
FIG. 6 is a front view of the steel-plate surface descaler.
Figure 7:
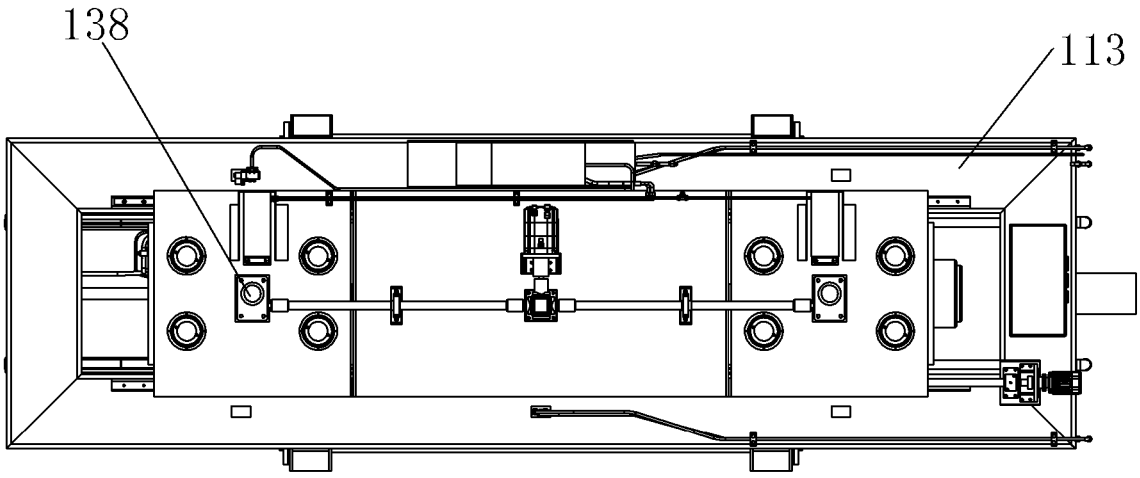
FIG. 7 is a top view of the steel-plate surface descaler.
Figure 8:
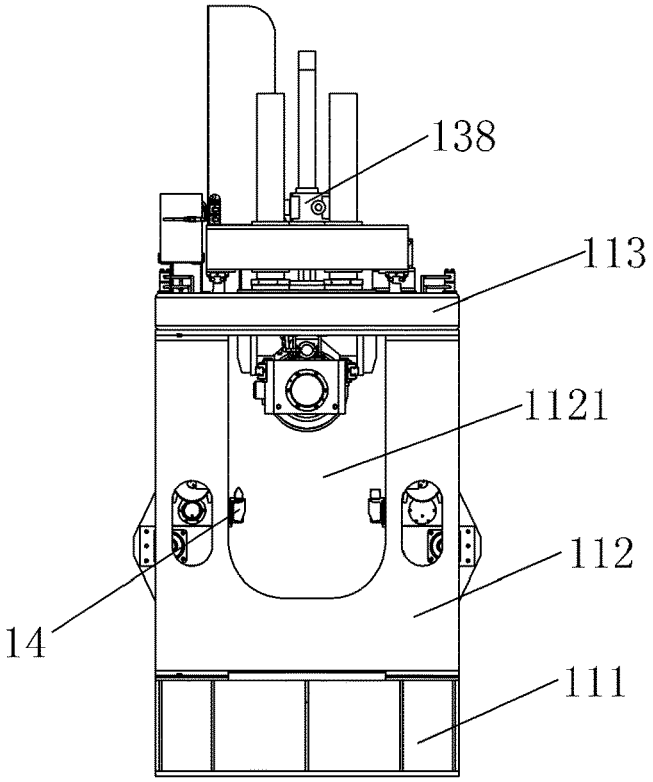
FIG. 8 is a side view of the steel-plate surface descaler.
Figure 9:
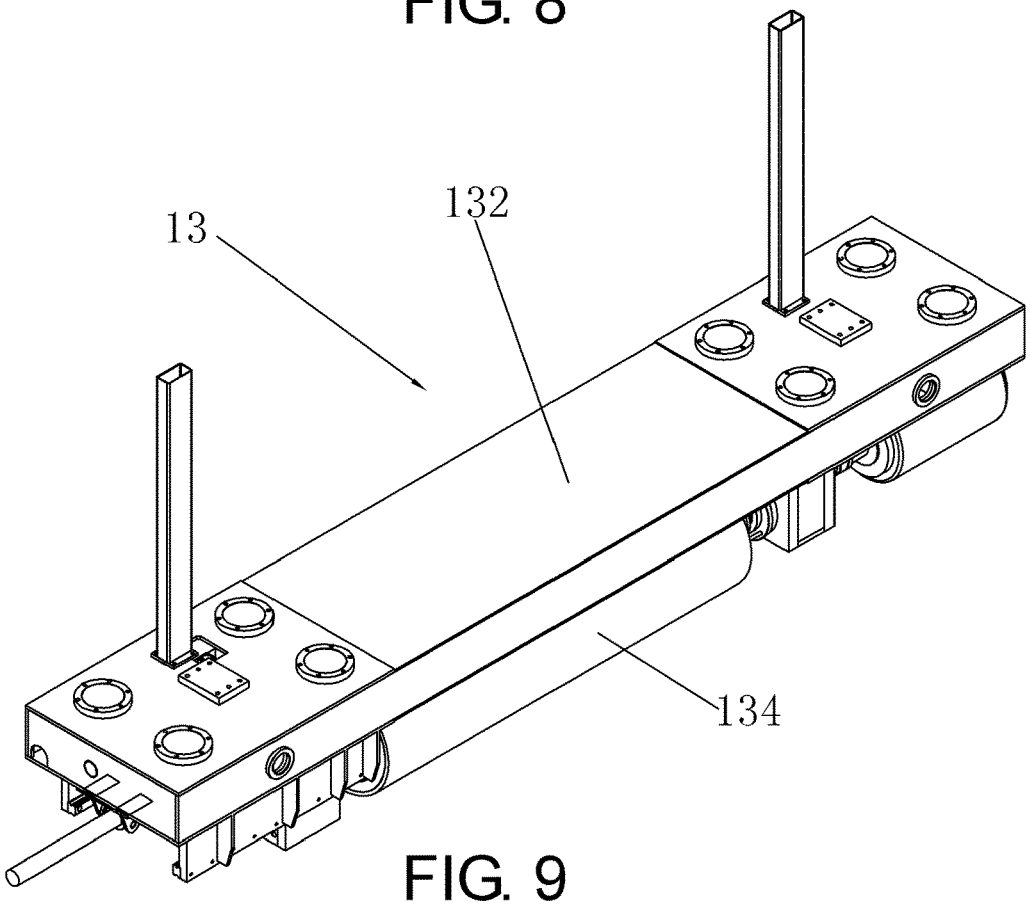
FIG. 9 is the first structural schematic view of a liftable descaling mechanism.
Figure 10:
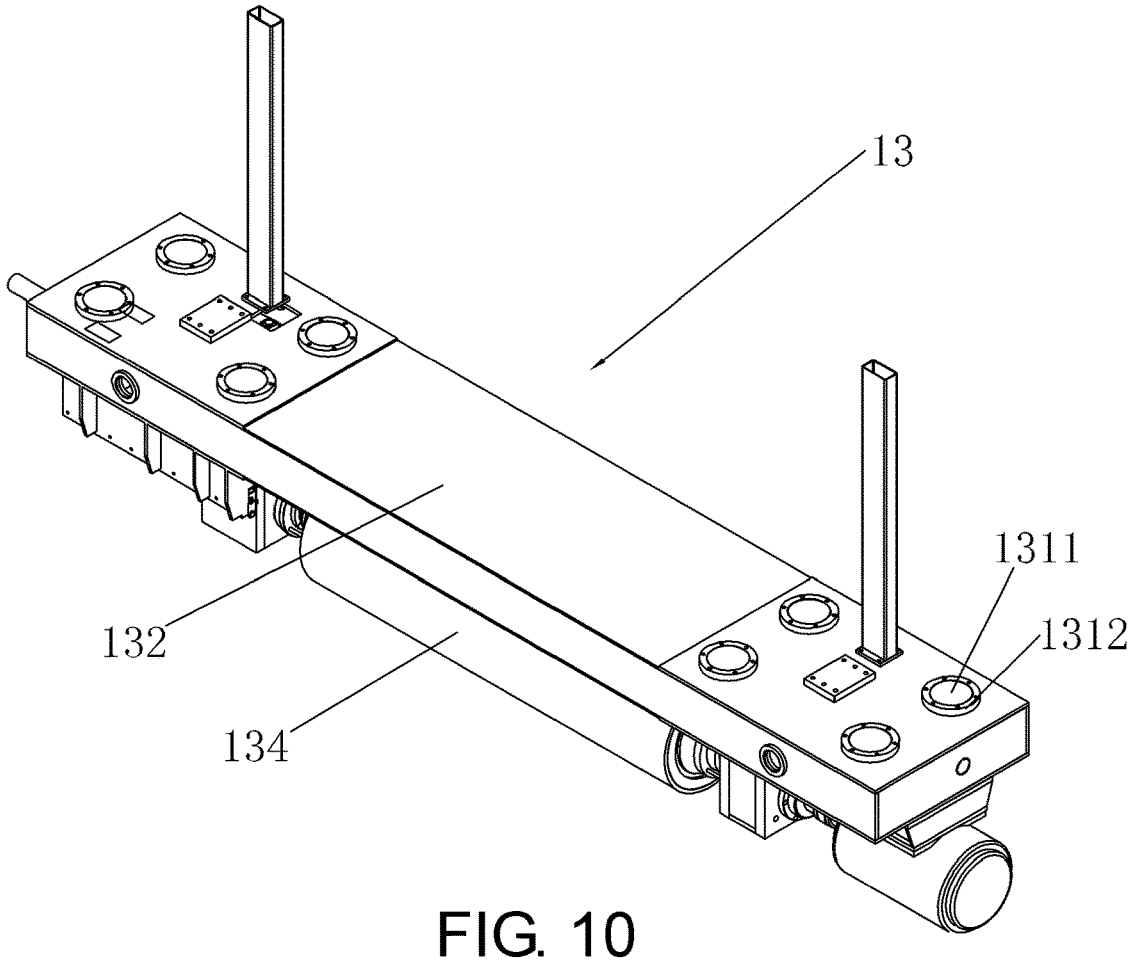
FIG. 10 is the second structural schematic view of the liftable descaling mechanism.

The roller-clamping mechanism 12 is arranged on one side of the base 111, and the entirety of the roller-clamping mechanism 12 is perpendicular to the direction of the steel plate traveling on a flow line. The roller-clamping mechanism 12 includes two vertical beams 121 arranged in parallel to and between the two side plates 112, and a pair of duo-rollers 122 arranged horizontally is provided on the vertical beams 121. The steel plate is sandwiched between the pair of duo-rollers. In order for the steel plate to be fixed in a vertical direction, and also to enable the pair of duo-rollers 122 to clamp steel plates of different thicknesses, the upper one of the pair of duo-rollers 122 is disposed to be movable in the vertical direction and to be fixed. The specific structure thereof is shown in FIG. 4. Two duo-roller lifting-and-clamping mechanisms 123 are arranged opposite to each other on the two vertical beams 121. The duo-roller lifting-and-clamping mechanism 123 includes a duo-roller lifting cylinder 1231, a duo-roller shaft seat 1232, a lifting gear 1233, and a lifting rack 1234. The both ends of the upper one of the duo-rollers 122 are fixed respectively in the duo-roller shaft seat 1232. The duo-roller lifting cylinder 1231 is connected with the duo-roller shaft seat 1232 and is adapted to drive the duo-roller shaft seat 1232 to move in the vertical direction. The lifting gear 1233 is provided on the outer side of the duo-roller shaft seat 1232, and the lifting rack 1234 is provided fixedly on the vertical beam 121. When the steel plate enters the space between the duo-rollers 122, the duo-roller lifting cylinder 1231 drives the duo-roller shaft seat 1232 to move downward and clamp the steel plate. During this process, the lifting gear 1233 moves downward and maintains to mesh with the lifting rack 1234. On the lifting rack 1234, a stopper curtain 1235 is fixed to restrict the lifting gear 1233 from moving outward along its axis.

As shown in FIG. 3 and FIG. 9 to FIG. 23, the liftable descaling mechanism 13 includes an upper beam 131, a chief operating beam 132, a bearing base 133, and a descaling roller 134. The chief operating beam 132 is arranged below the upper beam 131. Upon the upper beam 131, it is provided with a lifting motor 135, an angle adjuster 136, a connecting shaft 137, and a lifting mechanism 138. The angle adjuster 136 is provided at the center of the upper beam 131. One connecting shaft 137 is provided on both sides of the angle adjuster 136. One end of the connecting shaft 137 is disposed on the angle adjuster 136, and the other end of the connecting shaft 137 is in corporation with the lifting mechanism 138. The lifting motor 135 is connected with the angle adjuster 136 for driving the connecting shaft 137 to rotate, thereby impelling the lifting mechanism 138 to operate. Since the lower end of the lifting mechanism 138 is connected with the chief operating beam 132, the chief operating beam 132 moves in a vertical direction as it is driven by the lifting mechanism 138. There are two bearing bases 133, a first bearing base 13300 and a second bearing base 13301. The two bearing bases 133 are disposed respectively to both sides of the lower end of the chief operating beam 132, and the both ends of the descaling roller 134 are disposed on the two bearing bases 133.

The process of adjusting the chief operating beam 132 to go upward and downward is as follows. An output end of the lifting motor 135 drives the connecting shaft 137 to rotate through the angle adjuster, driving the lifting mechanism 138 to operate. And the lifting mechanism 138 is a worm gear mechanism. That is to say, the other end of the connecting shaft 137 is fixed to a worm gear that rotates synchronously, and the worm gear meshes with a worm vertically disposed. The worm is disposed within a worm protecting sleeve 1381. The lower end of the worm passes through the upper beam 131 and connects the chief operating beam 132. And the lifting mechanism finally drives the chief operating beam 132 to move in the vertical direction, thereby implementing the lifting of the descaling roller.

A first linear slide rail 15 is disposed in the front and rear sides of the upper bracket 113. A first linear slider 16 is disposed on the first linear slide rail 15, and the lower end of the upper beam 131 is fixed on the first linear slider 16. An upper-beam driving mechanism 17 is disposed on one side of the left and right sides of the upper bracket 113, and the upper-beam driving mechanism 17 is adapted to drive the upper beam 131 to move back and forth on the first linear slide rail 15. The upper-beam driving mechanism 17 is composed of an upper-beam decelerating motor 171 and an upper-beam driving screw 172. The upper-beam decelerating motor 171 drives the upper-beam driving screw 172 to thereby drive the upper beam 131 to move back and forth. Specifically, such configuration may be adopted so that the output end of the upper-beam decelerating motor 171 is connected with the upper-beam driving screw 172, and one end of the upper-beam driving screw 172 is restricted to a screw-rod seat 173, allowing the upper-beam driving screw 172 to rotate only along the screw-rod seat 173. And the other end of the upper-beam driving screw 172 is threadedly connected with a nut (not illustrated), and the nut is fixedly connected with the upper beam 131, such that the rotation of the upper-beam driving screw 172 drives the nut and the upper beam 131 to move synchronously.

Two groups of through holes 1311 are provided on the left and right sides of the upper beam 131. Each group of the through holes 1311 is composed of four through holes 1311 arranged in a rectangular shape. And each through hole 1311 is provided with a guide sleeve 1312. Two groups of guide rods 1321 are respectively provided at both ends of the chief operating beam 132. Each group of the guide rods 1321 includes four guide rods which are each located at the four vertices of a rectangle. And the four guide rods 1321 on the same side respectively pass the four guide sleeves 1312 located on the same side.

By providing the first linear slide rail and the first linear slider, the upper beam disposed on the first linear slider may move back and forth on the first linear slide rail. And the effective length (referring to the part effective of descaling) of the descaling roller is longer than the width of the steel plate. The configuration of the descaling roller moving back and forth along with the upper beam increases the utilization efficiency and prolongs the service life of the descaling roller.

As shown in FIG. 9 to FIG. 15, a slide-rail supporting seat 1320 is provided at the end of the chief operating beam 132 that is farer away from the upper-beam driving mechanism 17. And the slide-rail supporting seat 1320 is provided with a shaft-seat slide rail 1322 on which a movable shaft-seat slider 1323 is provided on the shaft-seat slide rail 1322. And a first bearing base 13300 is provided on the shaft-seat slider 1323 to move back and forth on the shaft-seat slide rail 1322 through the shaft-seat slider 1323. A second bearing base 13301 is provided on the end of the chief operating beam 132 that is opposite to the first bearing base 13300, and the second bearing base 13301 is disposed fixedly.

A drive cylinder 139 is installed on a bottom surface of the end of the chief operating beam 132 disposed with the shaft-seat slide rail 1322. And the drive cylinder 139 is articulated with a cylinder seat 1390 installed on the bottom surface of the chief operating beam 132. A hydraulic rod of the drive cylinder 139 is connected with the first bearing base 13300 on its same side, for driving the first bearing base 13300 to move back and forth on the shaft-seat slide rail 1322.

Figure 11:
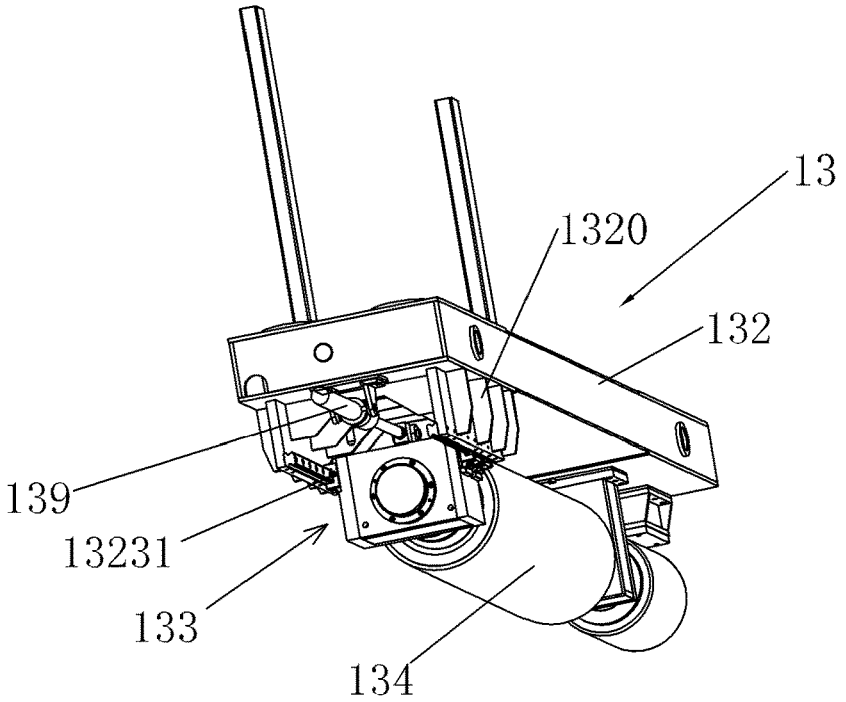
FIG. 11 is the third structural schematic view of a liftable descaling mechanism.
Figure 12:
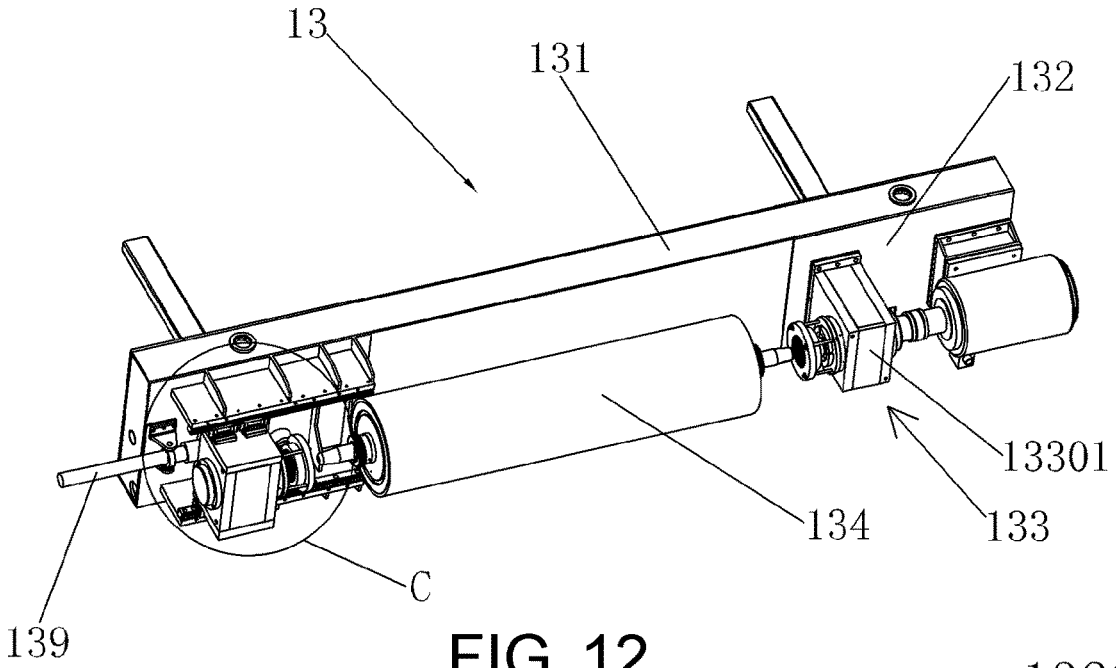
FIG. 12 is the fourth structural schematic view of the liftable descaling mechanism.
Figure 13:
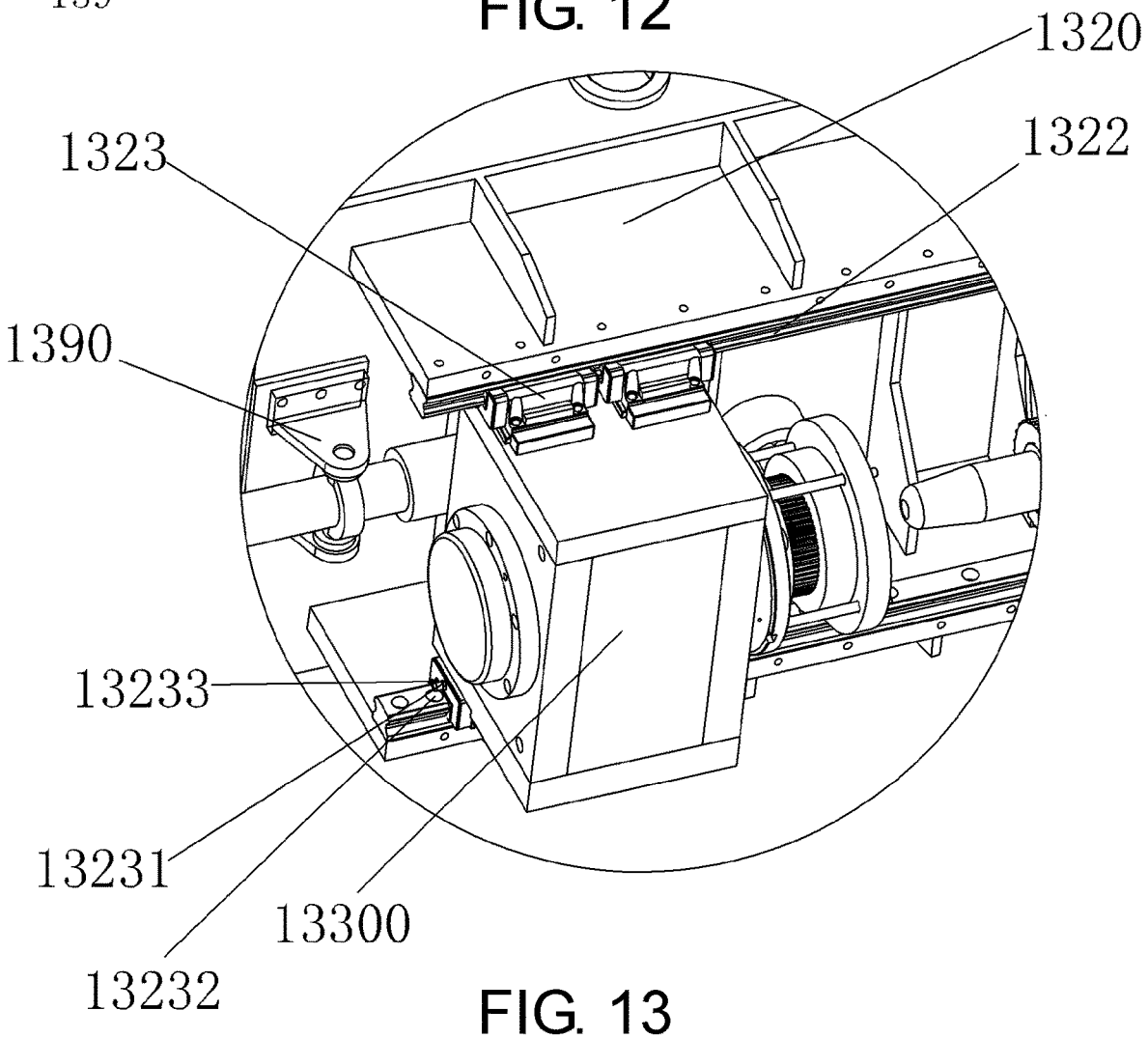
FIG. 13 is a partially enlarged diagram of the area C shown in FIG. 12.
Figure 14:
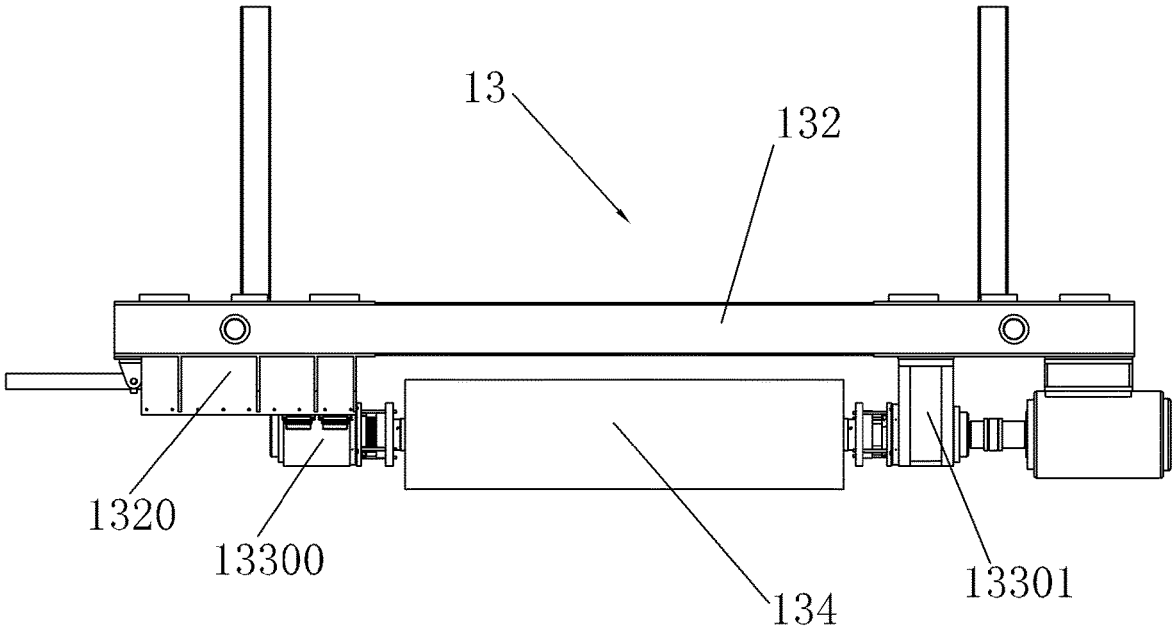
FIG. 14 is a front view of the liftable descaling mechanism (in which a descaling roller is fully engaged).
Figure 15:
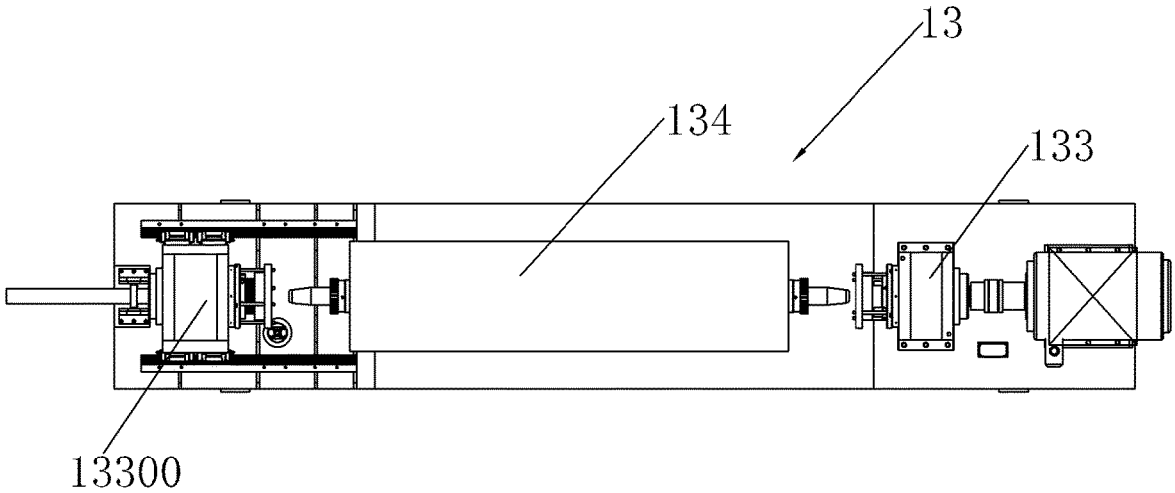
FIG. 15 is a bottom view of the liftable descaling mechanism (in which the descaling roller is fully disengaged).
Figure 16:
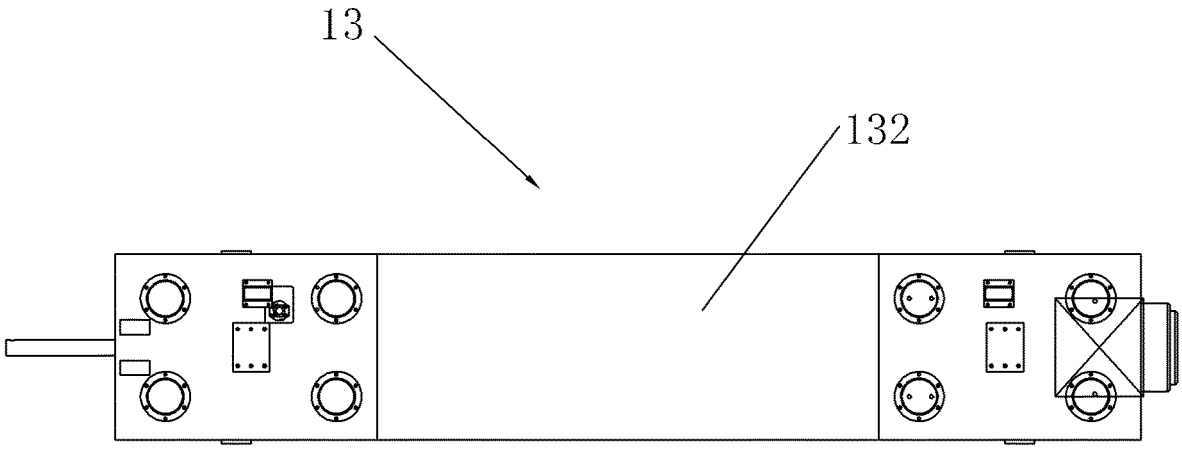
FIG. 16 is a top view of the liftable descaling mechanism.
Figure 17:
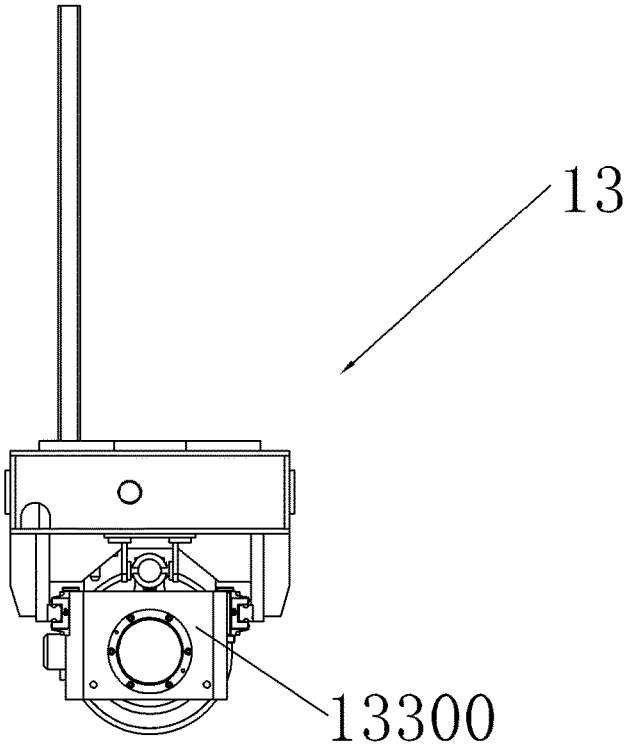
FIG. 17 is a side view of the liftable descaling mechanism.
Figure 18:
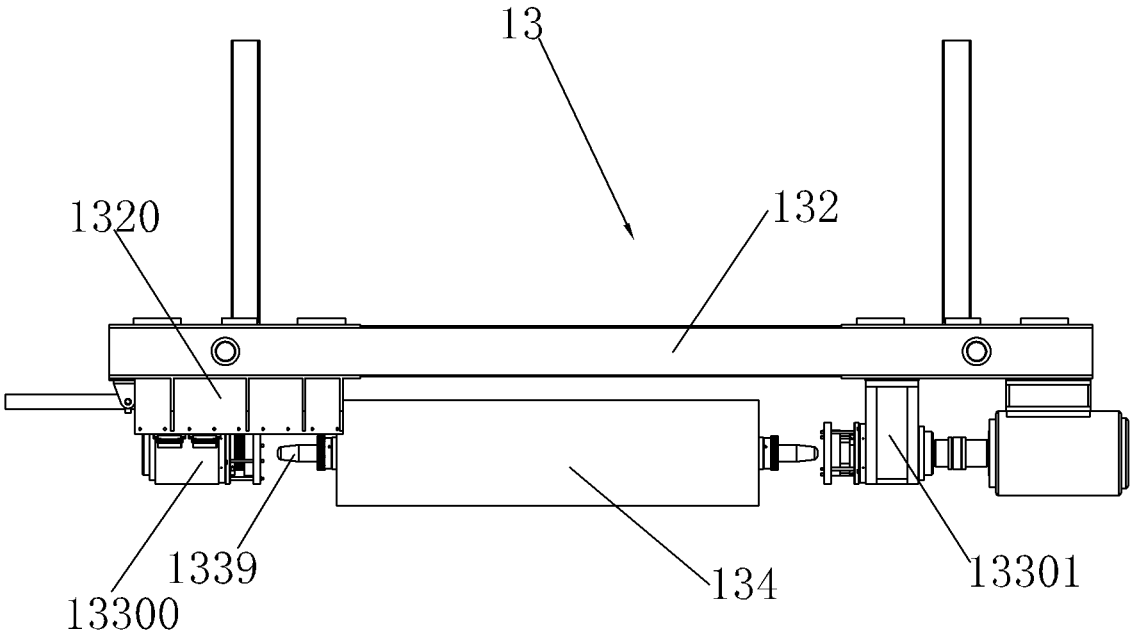
FIG. 18 is a front view of the liftable descaling mechanism (in which the descaling roller is fully disengaged).

In the operating state, since the descaling roller 134 is rotating, in order to prevent the bearing base from moving on the shaft-seat slide rail 1322 due to the pressure loss in the drive cylinder 139, which causes the descaling roller 34 to disengage as shown in FIG. 11, a safety pin 13231 is provided on the shaft-seat slider 1323. The safety pin 13231 is L-shaped, and it may be provided in advance on the shaft-seat slider 1323. For example, the safety pin 13231 is threadedly connected with the shaft-seat slider 1323, the safety pin 13231 has a locking head 13233, and a plurality of locking holes 13232 are provided on the shaft-seat slide rail 1322. In the operating state, after the first bearing base 13300 is moved into place, the safety pin 13231 is rotated such that the locking head 13233 is inserted into the adjacent locking hole 13232, locking the shaft-seat slider 1323 and the shaft-seat slide rail 1322 together tightly. And this prevents effectively the bearing base from moving on the shaft-seat slide rail 1322 due to the pressure loss in the driving cylinder 139 which causes the descaling roller to disengage and thus the malfunction. Of course, a mounting hole may also be provided on the shaft-seat slider 1323. The safety pin 13231 may be inserted into the mounting hole after the first bearing base 13300 is moved into position.

A drive motor 1400 is provided next to the second bearing base 13301. Internal gears 1331 are provided for rotation respectively on the sides of the first bearing base 13300 and the second bearing base 13301 where they are opposite to each other. And spline couplings with teeth on the outer periphery are fixedly sleeved respectively on the shaft heads 1339 at both ends of the descaling roller 134. Here, the element in the image of the spline coupling may be termed an outer gear 1332. In the operating state, the outer gear 1332 sleeves and meshes with the inner gear 1331, and the drive motor 1400 drives the inner gear 1331 to rotate, which in turn drives the outer gear 1332 and the descaling roller 134 to rotate together to perform the descaling.

When the descaling roller 134 is worn out greatly and needs to be replaced with a new roller, it is easier to unload the roller with the following configuration. By disposing the shaft-seat slide rail 1322 and the shaft-seat slider 1323 on the chief operating beam 132, the first bearing base 13300 disposed on the shaft-seat slider 1323 is movable along the shaft-seat slide rail 1322. During the roller-changing operation, a roller-changing support device extends on the roller-changing rail and into a steel-plate surface descaler. The lifting motor drives the lifting mechanism to operate, lowering the chief operating beam 132, and the descaling roller falls on the roller-changing support device. At this time, the drive cylinder 139 pulls back, and the first bearing base 13300 moves toward the outer side on the shaft-seat slide rail 1322, such that one end of the descaling roller detaches the first bearing base 13300. Meanwhile, the upper-beam driving mechanism 17 drives the upper beam 131 to move along the first linear slide rail 15 so that the other end of the descaling roller detaches the second bearing base 13301. At this time, the roller-changing support device exits and brings out the worn descaling roller.

After that, the roller-changing support device extends and passes the new descaling roller into the steel-plate surface descaler. The lifting motor drives the lifting mechanism to operate such that the chief operating beam is lowered to a suitable position. The upper-beam driving mechanism drives the upper beam to move along the first linear slide rail, such that one shaft head of the descaling roller is disposed into the adjacent second bearing base. Meanwhile, the first bearing base moves toward the inner side on the shaft-seat slide rail, so that the other shaft head of the descaling roller is also fitted into the adjacent first bearing base. And the lifting motor drives the lifting mechanism to operate, so that the chief operating beam moves to the position preparing for further operation. Since the roller-loading operation mainly relies on the axial movement of the first bearing base 13300 and the upper beam 131, it is difficult for the teeth of the outer gear 133 to directly align with the tooth gap of the inner gear 1331. To address this issue, the embodiment provides the following configuration.

Figure 22:
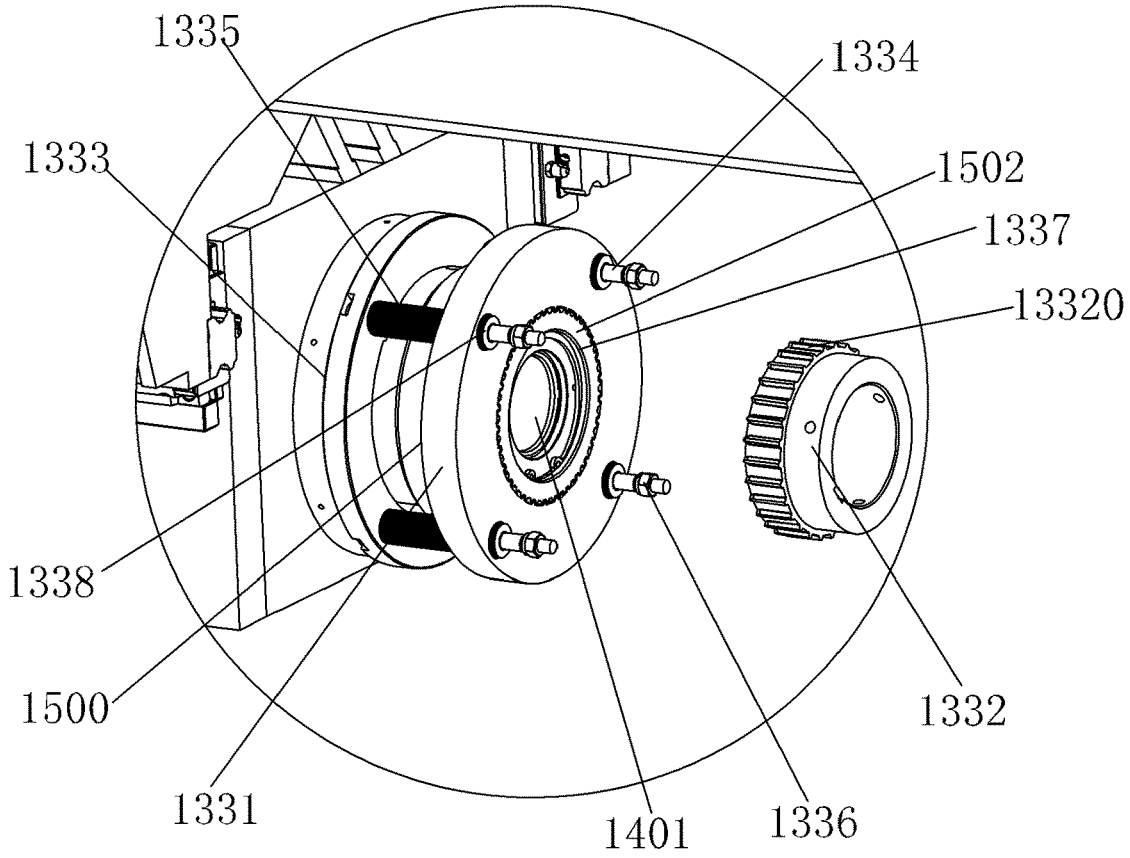
FIG. 22 is a partially enlarged diagram of the area D shown in FIG. 21.
Figure 44:
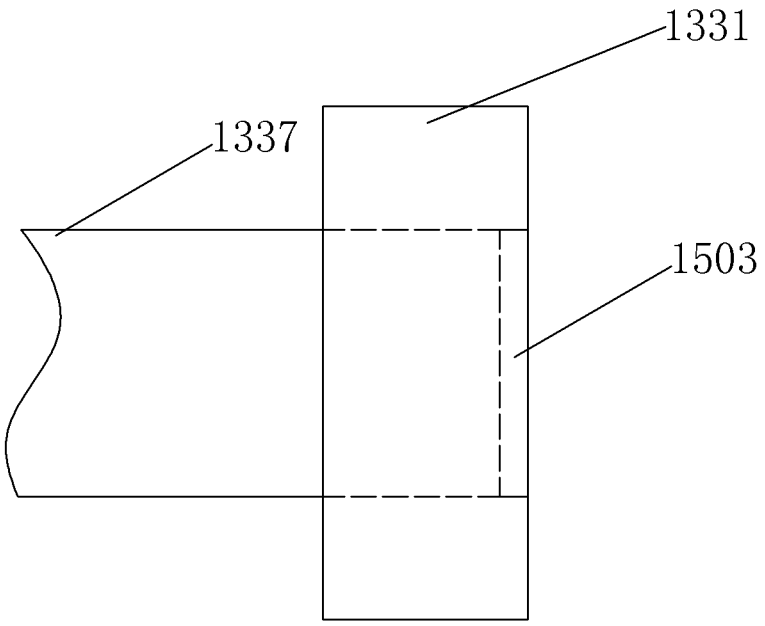
FIG. 44 is a schematic view of an internal structure of a gear shaft sleeving into an inner gear.

As shown in FIG. 22, elastic auxiliary mechanisms are installed on opposing sides of the two bearing bases 133. The elastic auxiliary mechanism includes a seat 1333, which is circular. The seats 1333 are rotatably installed on the first bearing base 13300 and the second bearing base 13301. Four screws 1334 are evenly installed on an end surface of the seat 1333. A first disc spring 1335 is sleeved on each screw. The four screws 1334 pass through the inner gear 1331. The seat 1333 is synchronously rotatable with the inner gear 1331. One end of the first disc spring 1335 contacts the seat 1333, and the other end of the first disc spring 1335 contacts the gear surface of the inner gear 1331. An adjustment nut 1336 and a pad 1338 are installed on the other end of the screw 1334. The outer gear 1332 is sleeved on and fixed to a shaft head 1339 of each of the both ends of the descaling roller 134. The descaling roller 233 is installed by engaging the inner gear 1331 and the outer gear 1332 with each other. The four screws 1334 pass through the inner gear 1331, and a rear end surface 1500 of the inner gear 1331 abuts against the first disc spring 1335, while a front end surface 13310 abuts against the pad 1338. A gear shaft 1337 is engaged and sleeved with the inner gear 1331. An exposed end 1502 of the gear shaft 1337 has a chamber 1401 for the shaft head 1339 to insert. The gear shaft 1337 is constantly engaged with the inner gear 1331. As shown in FIG. 44, the exposed end 1502 of the gear shaft 1337 is retracted inwardly with respect to the front end surface 13310 of the inner gear 1331 to provide a space 1503 for the outer gear 1332 to enter.

Figure 23:
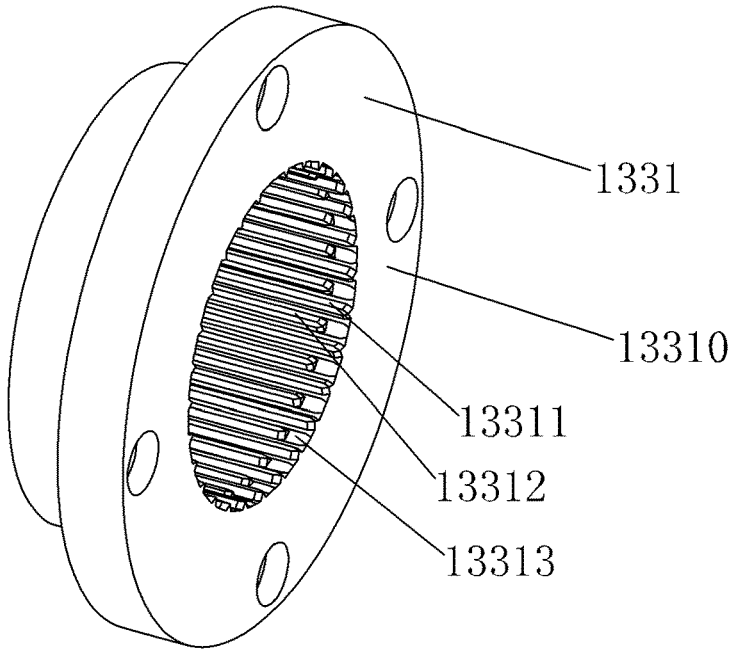
FIG. 23 is a structural schematic view of an inner gear.
Figure 24:
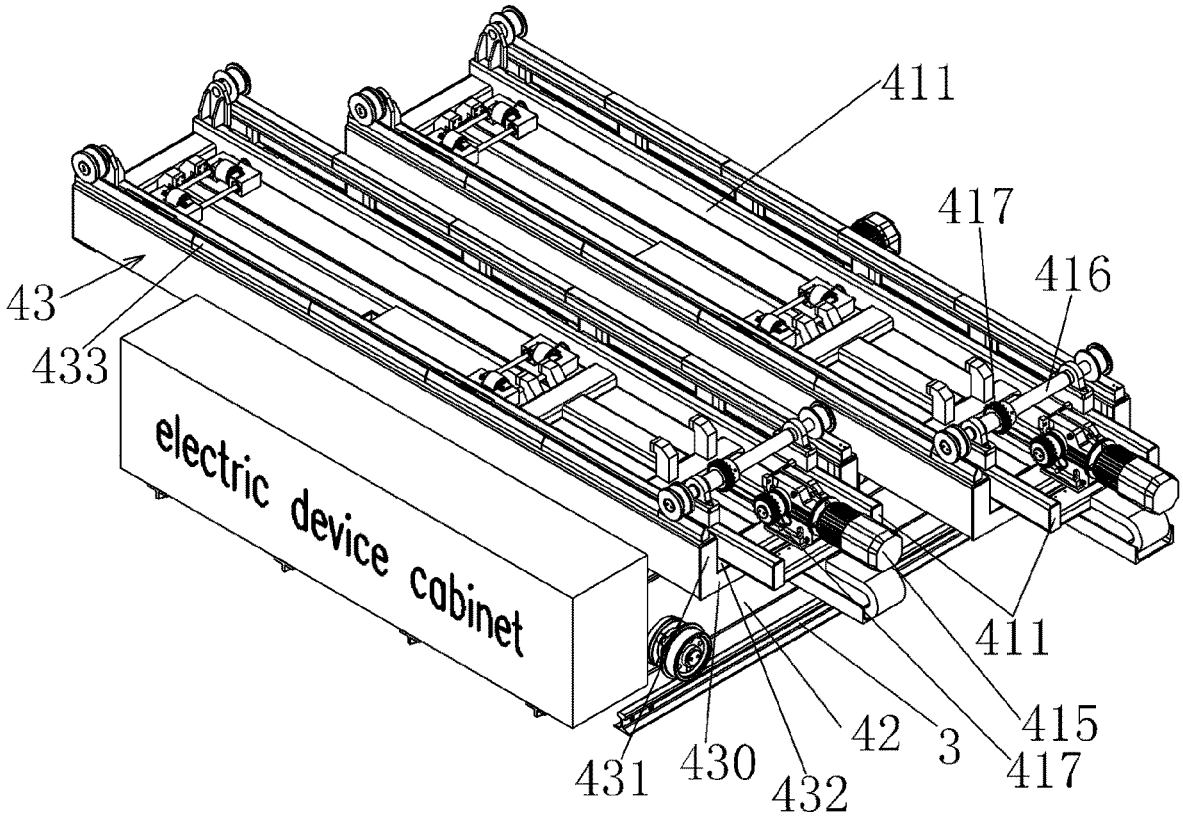
FIG. 24 is the first structural schematic view of a roller-changing vehicle.
Figure 25:
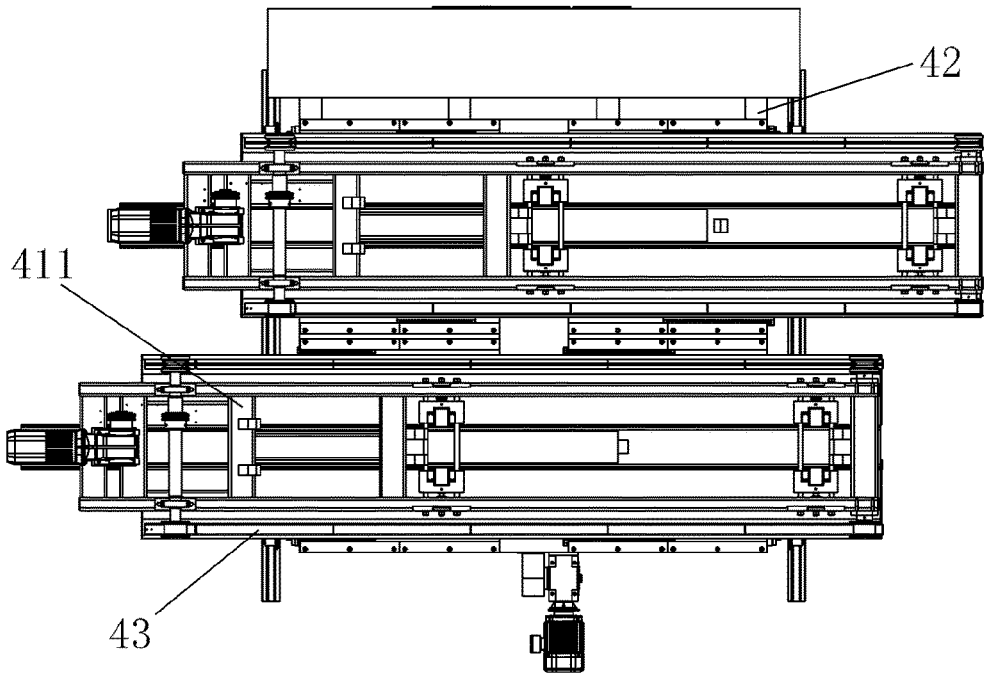
FIG. 25 is the first top view of the roller-changing vehicle.
Figure 26:
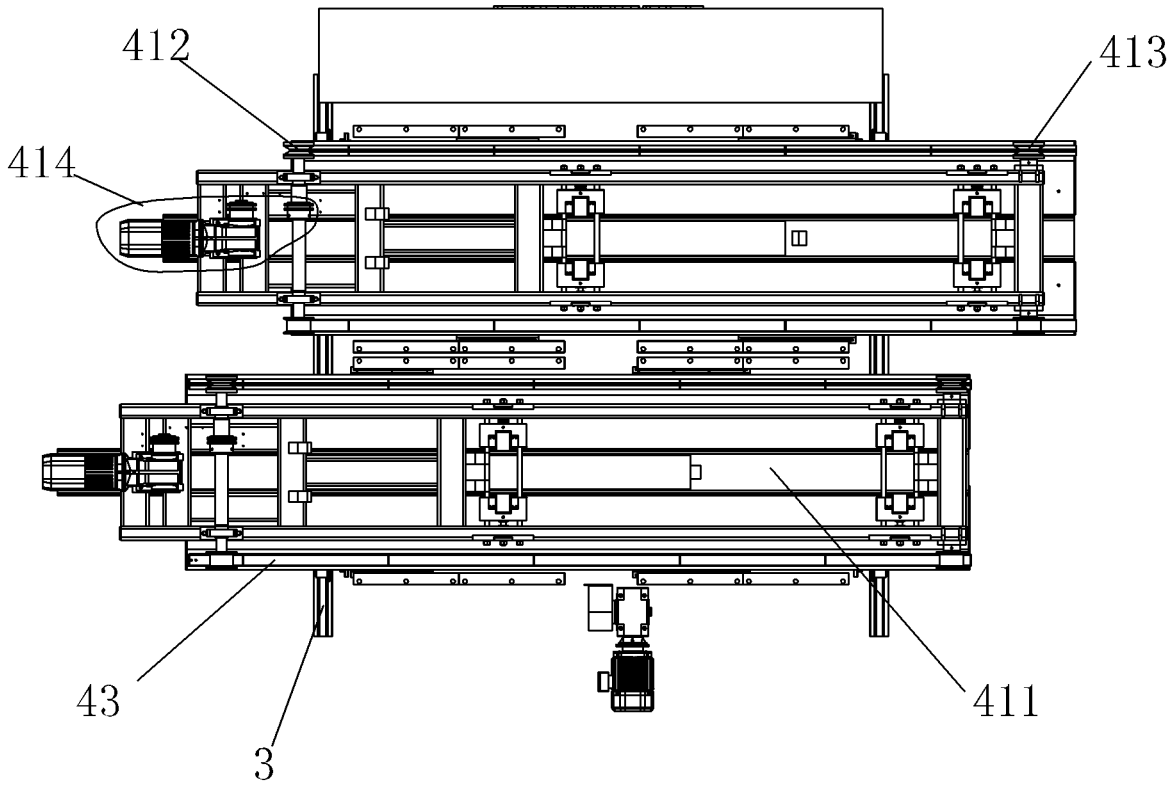
FIG. 26 is the second top view of the roller-changing vehicle.
Figure 27:
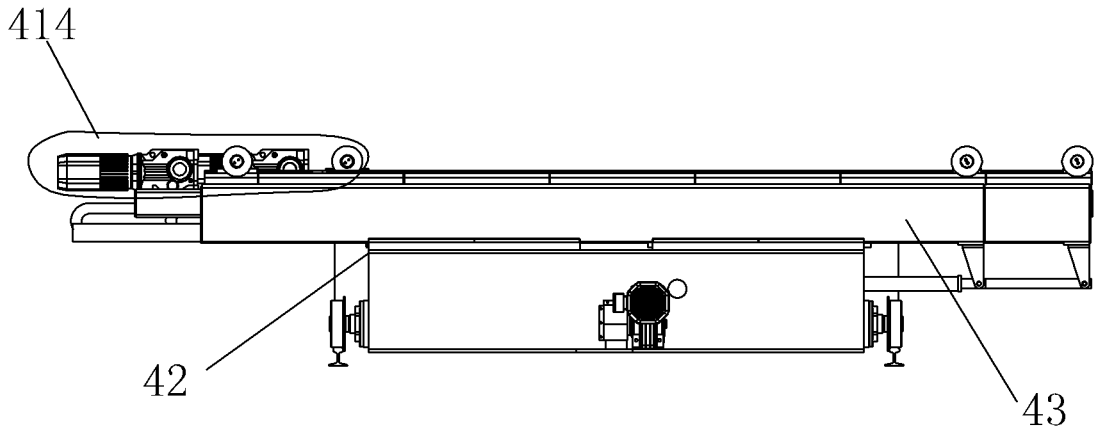
FIG. 27 is the first side view of the roller-changing vehicle.
Figure 28:
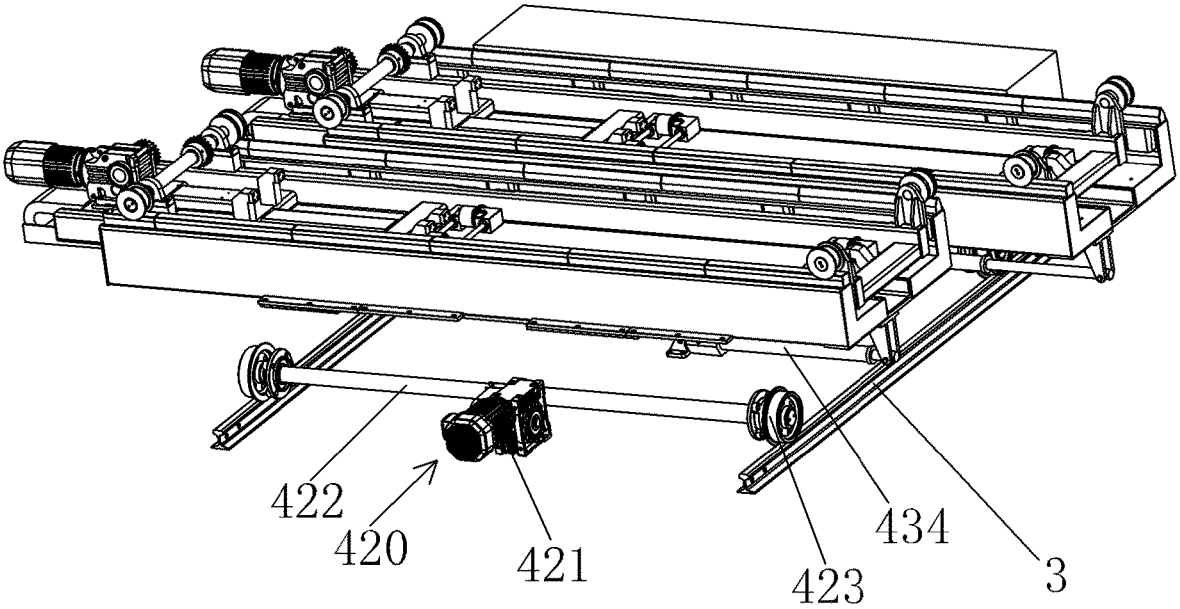
FIG. 28 is the second structural schematic view of the roller-changing vehicle.
Figure 29:
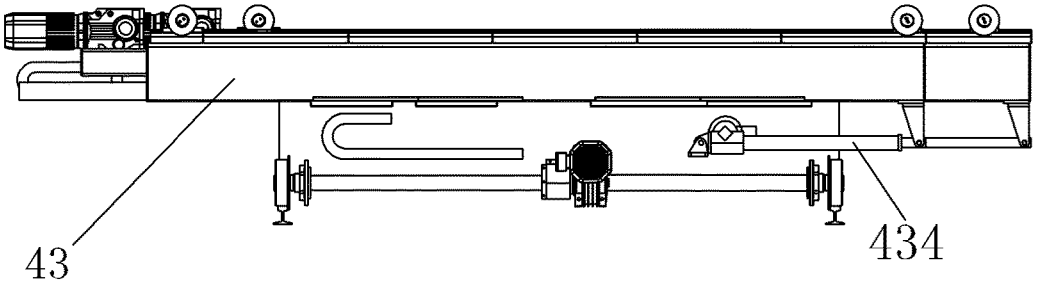
FIG. 29 is the second side view of the roller-changing vehicle.
Figure 30:
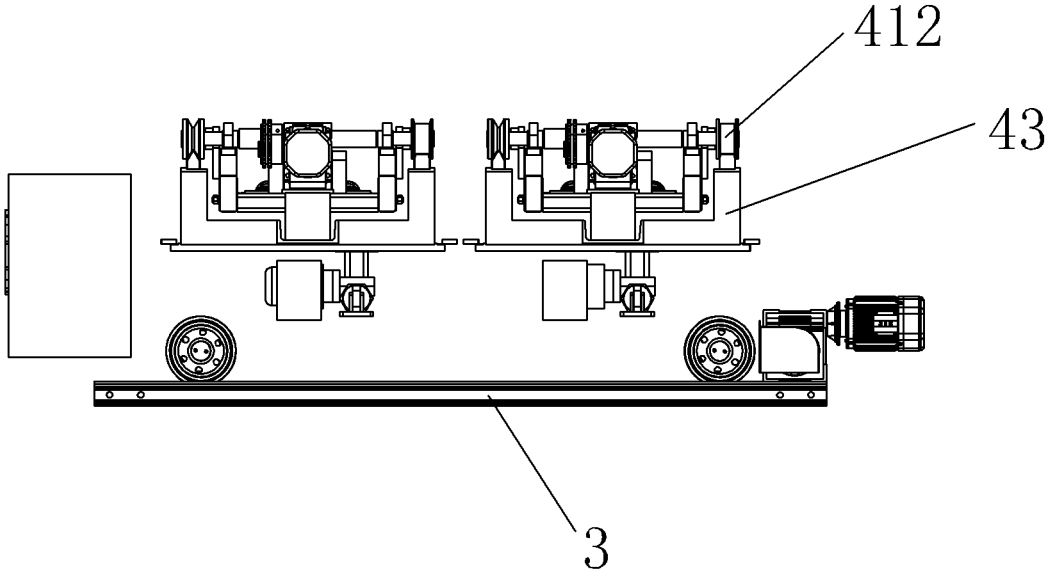
FIG. 30 is the third side view of the roller-changing vehicle.
Figure 31:
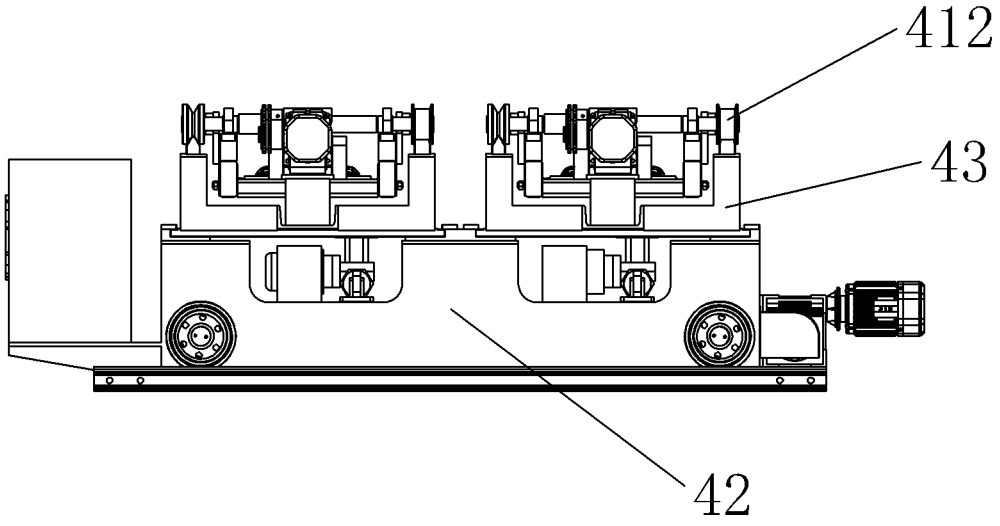
FIG. 31 is the fourth side view of the roller-changing vehicle.
Figure 32:
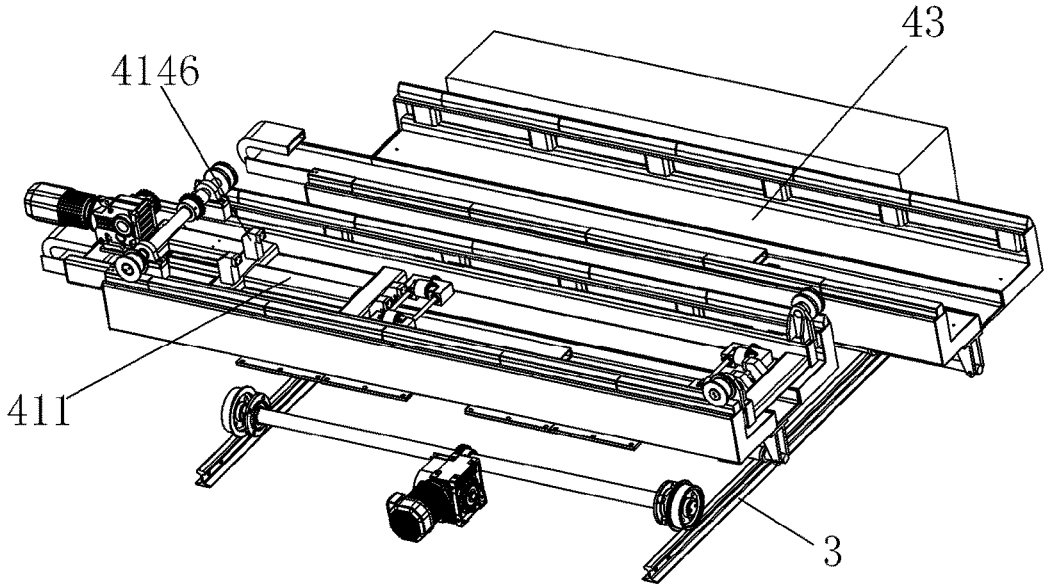
FIG. 32 is the third structural schematic view of the roller-changing vehicle.
Figure 33:
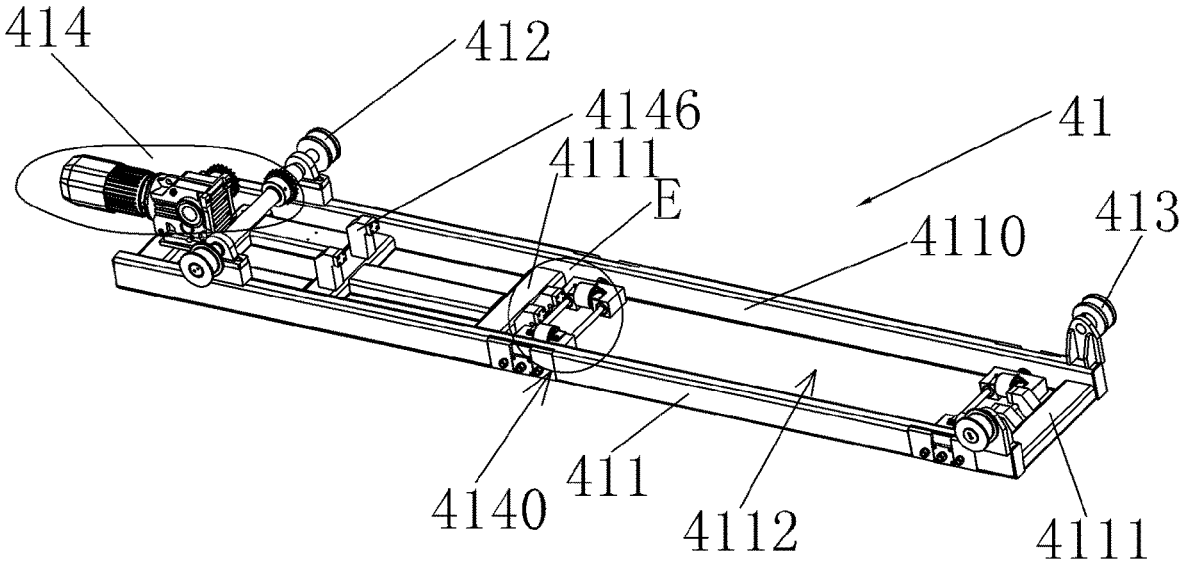
FIG. 33 is a structural schematic view of the roller-changing mechanism.
Figure 34:
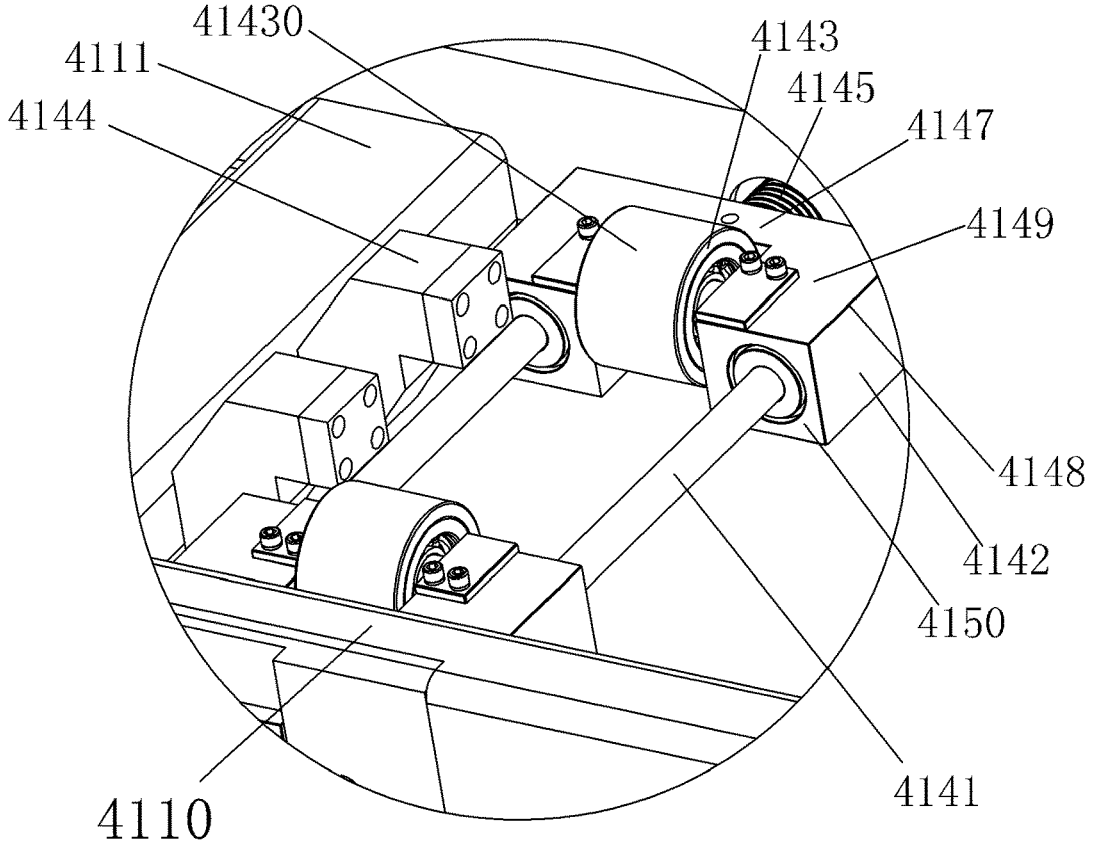
FIG. 34 is a partially enlarged diagram of the area E shown in FIG. 33.
Figure 35:
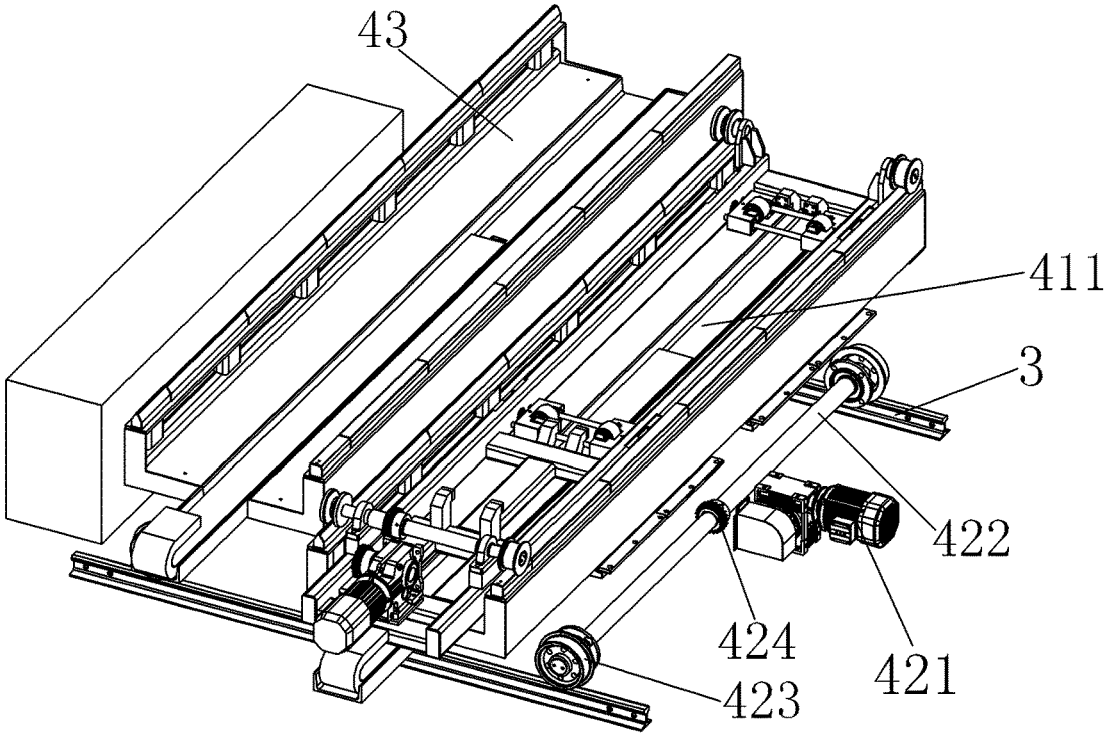
FIG. 35 is the fourth structural schematic view of the roller-changing vehicle.

As shown in FIG. 23, gear teeth are distributed along the circumferential direction on the inner circle of the inner gear 1331. In addition, the gear teeth of the inner gear 1331 include two types of gear teeth, i.e., long teeth 13311 and short teeth 13312 staggered along the circumferential direction. The short tooth 13312 is reduced from the front end surface 13310 of the inner gear 1331 toward the inner circle along the axial direction to provide a preset gap 13313. In other words, the preset gap 13313, which is greater, is provided between two adjacent long teeth 13311, and smaller gaps are formed between the two adjacent long teeth 13311 and the short tooth 13312.

The diameter of the outer gear 1332 is equal to the diameter of the gear shaft 1337. The outer gear 1332 is a comb gear, and teeth 13320 that are loosely arranged along the circumferential direction on the outer circumference of the outer gear 1332. In other words, the number of the teeth 13320 may be a half or a quarter of the sum of the long and short teeth of the inner gear 1331. It is preferable that the sum of the long teeth 13311 and the short teeth 13312 is equal to twice of the number of the teeth 13320 of the outer gear 1332. For example, the sum of the long and short teeth of the inner gear may be 44, whereas the number of the teeth 13320 of the outer gear is 22.

Figure 19:
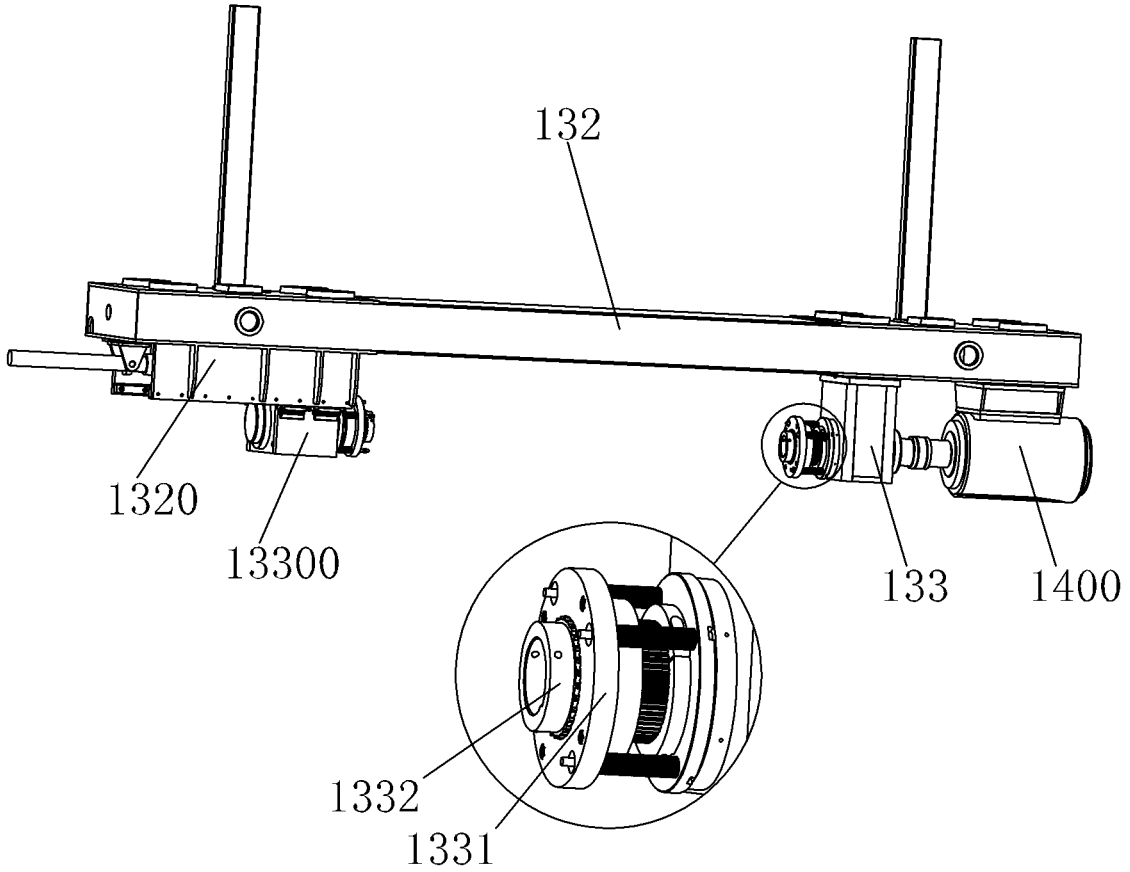
FIG. 19 is the fifth structural schematic view of the liftable descaling mechanism (without the descaling roller).
Figure 20:
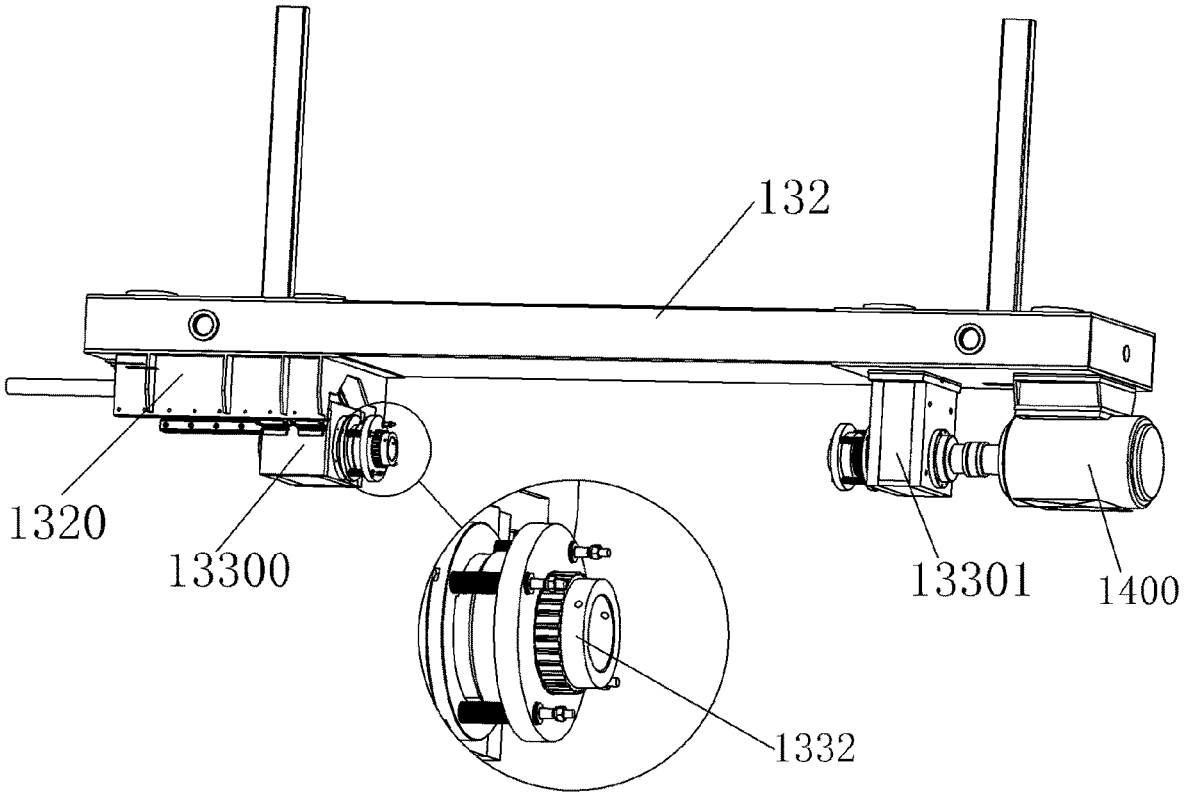
FIG. 20 is the sixth structural schematic view of the liftable descaling mechanism (without the descaling roller).
Figure 21:
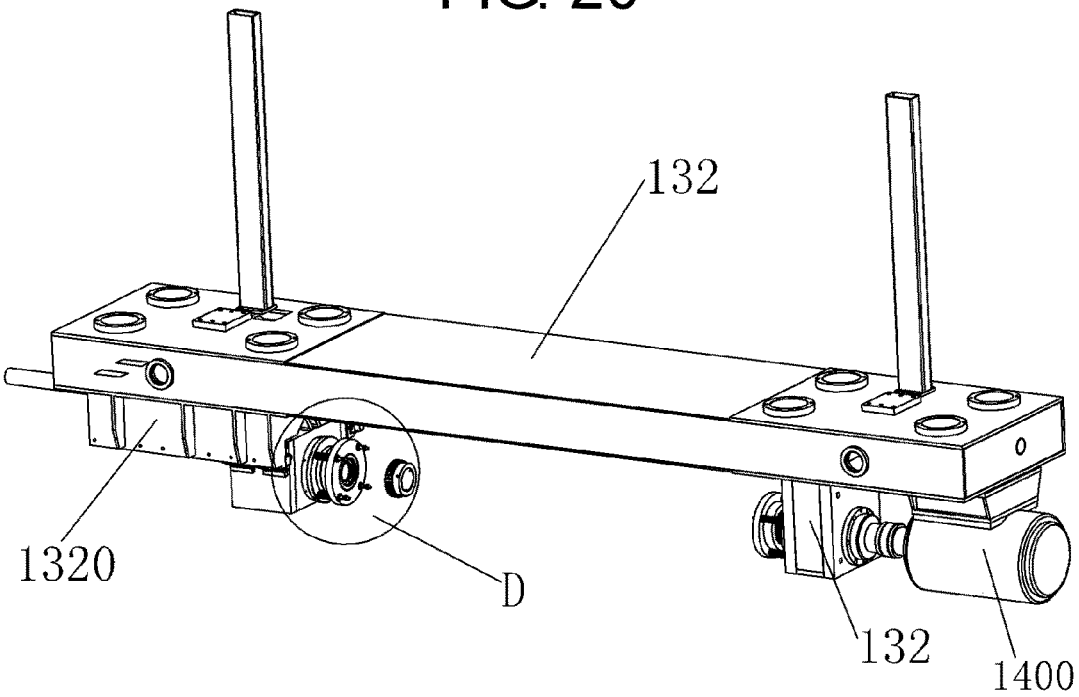
FIG. 21 is the seventh structural schematic view of the liftable descaling mechanism (without the descaling roller).

By engaging and sleeving the gear shaft with the inner gear, the inner gear and the gear shaft are fixed to each other in the circumferential direction, and whereas the inner gear 1331 is movable along the shaft direction. During the process of installing the descaling roller, the shaft heads 1339 at the both ends of the descaling roller firstly enter the chambers 1401 of the gear shafts 1337. Then, the descaling roller ascends through the acting of the lifting motor, and, as shown in FIG. 20, the outer gears 1332 at the both ends of the descaling roller is close to the front end surfaces 13310 of the inner gears 1331. Since the descaling roller is position-limited or remains unmoved in the axial direction, the outer gears 1332 do not move, whereas the gear shafts 1337 and the inner gears 1331 continue to move. In addition, the inner gears 1331 are pressed by the outer gears 1332 in opposite directions, and the first disc springs 1335 are compressed to generate an elastic force. Meanwhile, the output end of the drive motor 1400 drives the gear shaft on the second bearing base 13301 to rotate. When the gaps 13313 are aligned with the teeth 13320, the inner gears 1331 are moved backward through the acting of the elastic forces, and the outer gears 1332 firstly enter the spaces 1503. Meanwhile, the teeth 13320 of the outer gears enter the larger gaps 13313 formed between the long teeth in the inner gears. In such case, the teeth 13320 of the outer gears are refrained from entering the gaps between the long teeth 13311 and the short teeth 13312. For example, the teeth 13320 abut against the short teeth 13312 of the inner gears 1331, and the disc springs 1335 are pressed again by the inner gears 1331 to generate elastic forces. At this time, the gear shafts 1337 continue rotating. When the teeth 13320 are aligned with the smaller gaps between the long teeth 13311 and the short teeth 13312, the first disc springs 1335 again release elastic forces to push the inner gears 1331 back toward the direction of the descaling roller. Eventually, the teeth 13320 enter the smaller gaps between the long teeth 13311 and the short teeth 13312, as shown in FIG. 19, and the inner gears 1331 and the outer gears 1332 are sleeved and engaged with each other. Accordingly, the power connection between the inner gears 1331 and the outer gears 1332 is realized, and the descaling roller 134 is thus rotatable. The design of the outer gear as a comb gear makes it convenient to engage with the inner gear.

As shown in FIG. 24 to FIG. 37, the roller-changing vehicle 4 includes a base 42 that travels on the vehicle rail 3. The base 42 is provided with a first transmission mechanism 420. In the present embodiment, the first transmission mechanism 420 is driven by a sprocket transmission mechanism, which includes a first motor decelerator 421 and a rolling shaft 422 which are disposed on the base 42. Rolling wheels 423 are disposed at both ends of the rolling shaft 422. A first sprocket 424 is disposed on the rolling shaft 422. The output end of the first motor decelerator 421 is also connected with a sprocket, and the sprocket forms a synchronous linkage with the first sprocket 424 through a chain (not illustrated), driving the rolling wheels 423 to roll on the vehicle rail 3.

Two roller-guiding seats 43 are installed side by side on the base 42. The roller-guiding seat 43 is connected with a roller-guiding-seat driving mechanism 434. The roller-guiding seat 43 moves on a longitudinal direction of the roller-guiding seat 43 through the acting of the roller-guiding-seat driving mechanism 434. The roller-guiding seat 43 includes a bottom plate 430 and fencing plates 431 extending upward along the left and right sides of the bottom plate 430. The bottom plate 430 and the two fencing plates 431 enclose to form a rail groove 432, and a roller-changing support device 41 is located in the rail groove 432 of the roller-guiding seat 43. On one of the roller-changing support device 41, a new descaling roller is placed, and the other roller-changing support device 41 is empty, ready for the dismantled descaling roller. The roller-guiding-seat driving mechanism 434 is an electric push rod, which of course may also be a hydraulic rod. One end of the electric push rod is disposed on and articulated with the bottom plate 42, and the other end of the electric push rod is articulated with the bottom plate 430 of the roller-guiding seat 43. The expansion and contraction of the electric push rod drive the roller-guiding seat 43 to move. The moving direction of the roller-changing vehicle 4 is perpendicular to the moving direction of the roller-guiding seat 43 and the roller-changing support device 41.

A traveling rail 433 is installed on the upper end of a fencing plate 431 in a longitudinal direction of the fencing plate 431, such that the roller-changing support device 41 may travel on the traveling rail 433 which is at the same height as that of the roller-changing rail 14 of the steel-plate surface descaler 1. When the roller-changing vehicle 4 moves on the vehicle rail 3 to the side of the steel-plate surface descaler 1, after the traveling rail 433 of the guide-roller seat 43 is aligned with the roller-changing rail 14, the guide-roller-seat drives mechanism drives the roller-guiding seat 43 to move, so that the traveling rail 433 is in contact and aligned with the roller-changing rail 14. The roller-changing support device 41 moves on the traveling rail 433 of the roller-guiding seat 43 within the roller-changing rail 14 and then continues to move forward to the bottom of the descaling roller, preparing to change the roller.

The roller-changing support device 41 includes a moving seat 411. A second transmission mechanism 414 is installed at one end of the moving seat 411. And the second transmission mechanism 414 is a sprocket drive mechanism. Specifically, it includes a second motor decelerator 415 and a main spindle 416. The second motor decelerator 415 is installed at the end of the moving seat 411. The main spindle 416 is disposed above the moving seat 411 through a main-spindle bearing base 418. The both ends of the main spindle 416 are installed with driving wheels 412, and the driving wheels 412 are provided and traveling on the traveling rail 433. On both sides of the other end of the moving seat 411, driven wheels 413 that travel on the traveling rail 433 are also installed. The second motor decelerator 415 drives the main shaft 416 to rotate through the second sprocket 417 and a chain (not illustrated), so that the driving wheels 412 and the driven wheels 413 travel along the traveling rail 433 and the roller-changing rail 14.

A support mechanism 4140 for supporting the descaling roller 134 is also installed on the moving seat 411. There are two support mechanisms 4140, each supporting one end of the descaling roller 134. The moving seat 411 includes side bars 4110 that are laterally symmetrical to each other and a horizontal bar 4111 arranged at intervals to connect the two side bars 4110. The moving seat 411 is provided with a descaling-roller supporting area 4112. The support mechanism 4140 is arranged between the two side bars 4110, and the support mechanism 4140 is located at the both ends of the descaling-roller supporting area 4112 in the longitudinal direction.

The support mechanism 4140 includes a guide shaft 4141, a support block 4142, a support wheel 4143, a limit block 4144, and an elastic mechanism. The guide shaft 4141 is provided in pairs and is disposed between the two side bars 4110, and the both ends of each guide shaft 4141 are inserted into the side bars 4110. The support block 4142 is also provided in pairs, and each support block 4142 is close to one side bar 4110. The support block 4142 is U-shaped, including a support block body 4147 and clamping blocks 4148 located at both ends of the support block body 4147. The support wheel 4143 is installed between the two clamping blocks 4148. The central axis of the support wheel 4143 is parallel to the support block body 4147. The clamping block 4148 has an upper surface 4149 and a front surface 4150 that faces the other support block 4142. In the vertical direction, the wheel surface 41430 of the support wheel 4143 extends upward and beyond the upper surface 4149 of the clamping block 4148, whereas in the horizontal direction, the wheel surface 41430 of the support wheel 4143 extends beyond the front surface 4150 of the clamping block 4148 so as to support the descaling roller such that the descaling roller does not touch the clamping block 4148. The clamping blocks 4148 at both ends of the support block body 4147 are respectively inserted into the two guide shafts 4141 and slide along the guide shafts 4141. The elastic mechanism is arranged between the support block 4142 and the side bar 4110. In the present embodiment, the elastic mechanism adopts a disc spring, which may be termed a second disc spring 4145.

Figure 36:
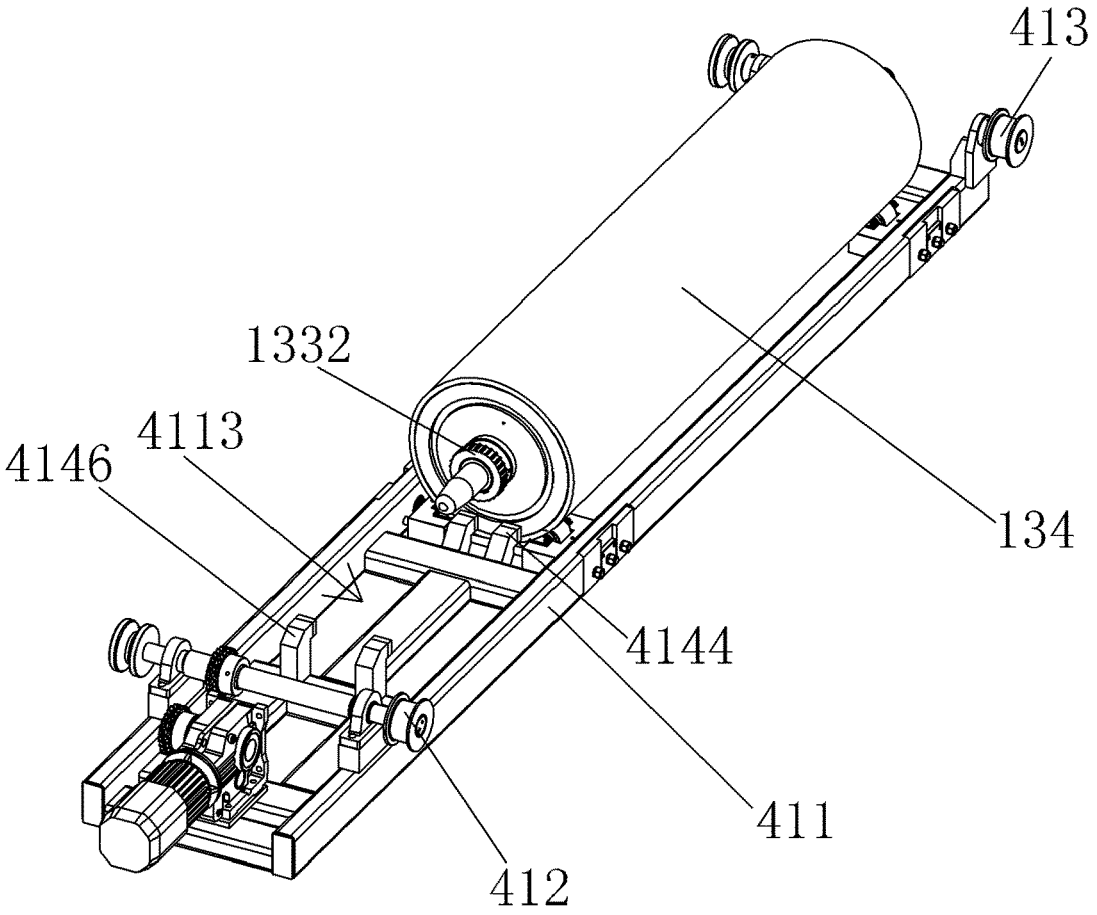
FIG. 36 is a schematic view of the cooperation between the roller-changing mechanism and the descaling roller.
Figure 37:
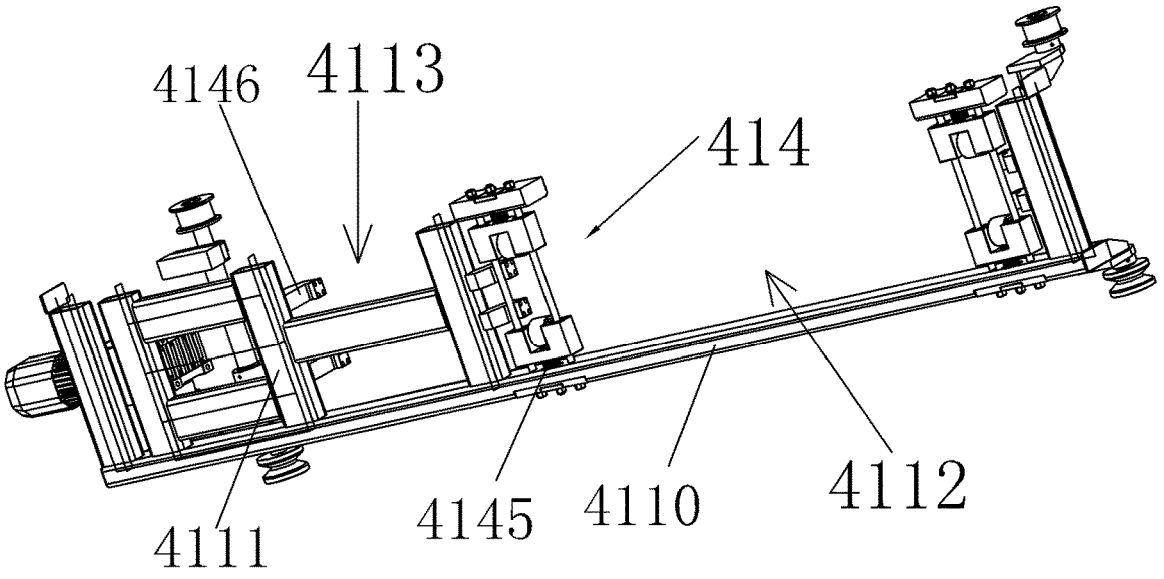
FIG. 37 is a structural schematic view of important components of the roller-changing mechanism.
Figure 38:
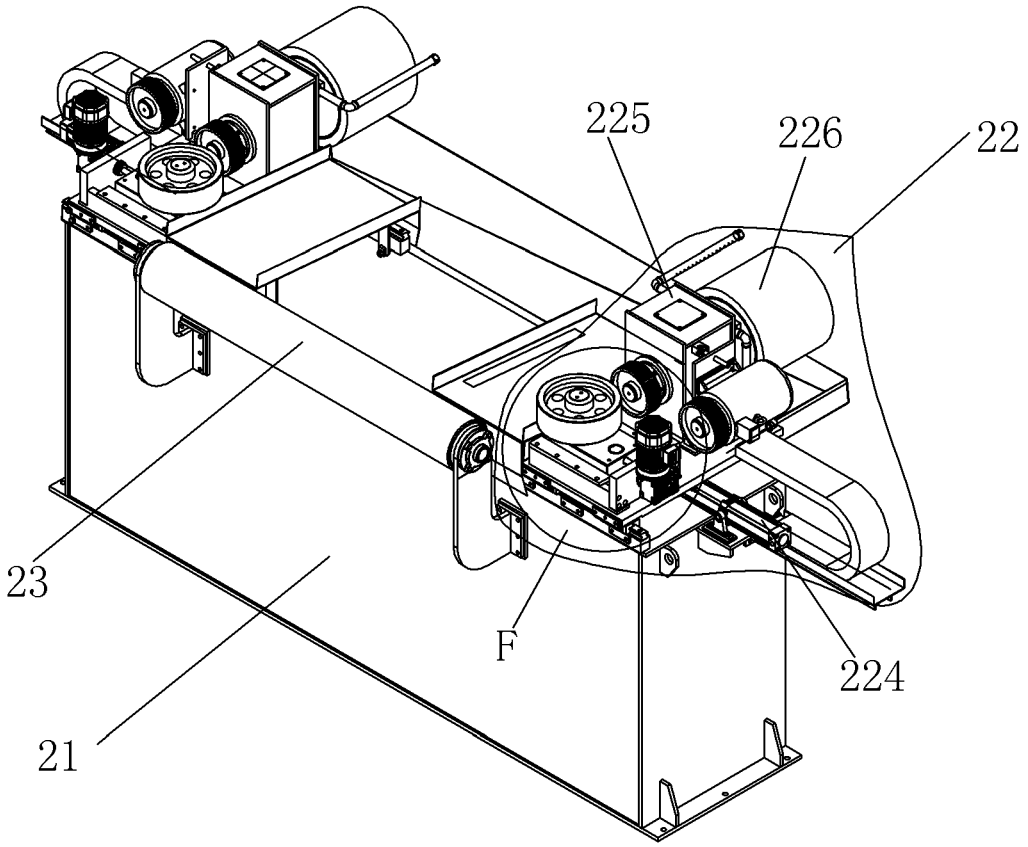
FIG. 38 is the first structural schematic view of a steel-plate side-surface descaler.
Figure 39:
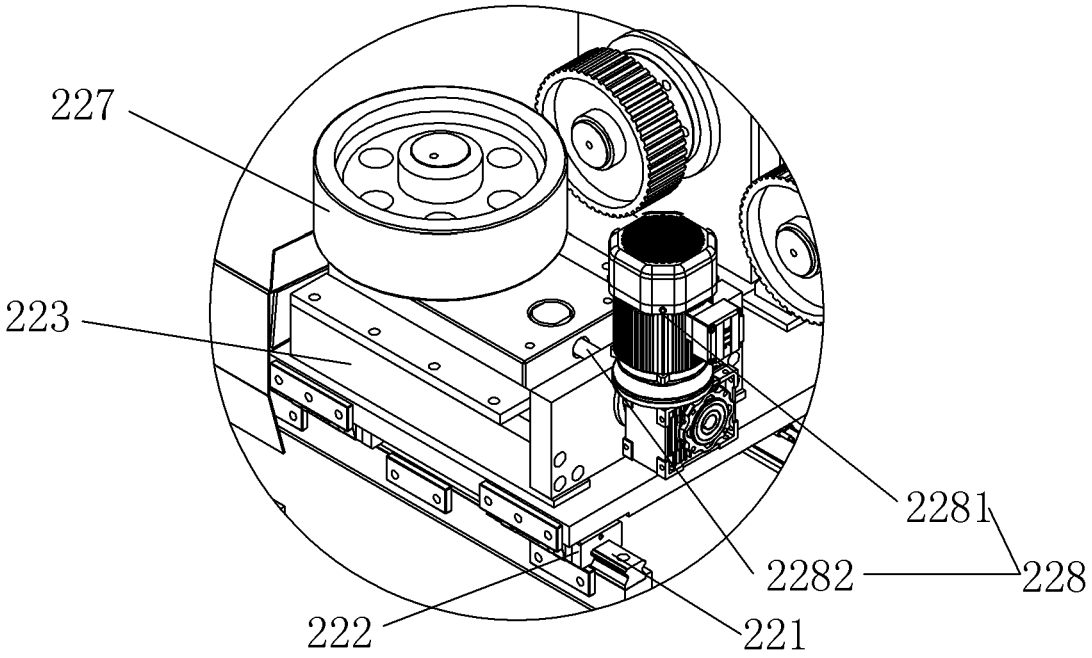
FIG. 39 is a structural schematic view of the area F shown in FIG. 38.
Figure 40:
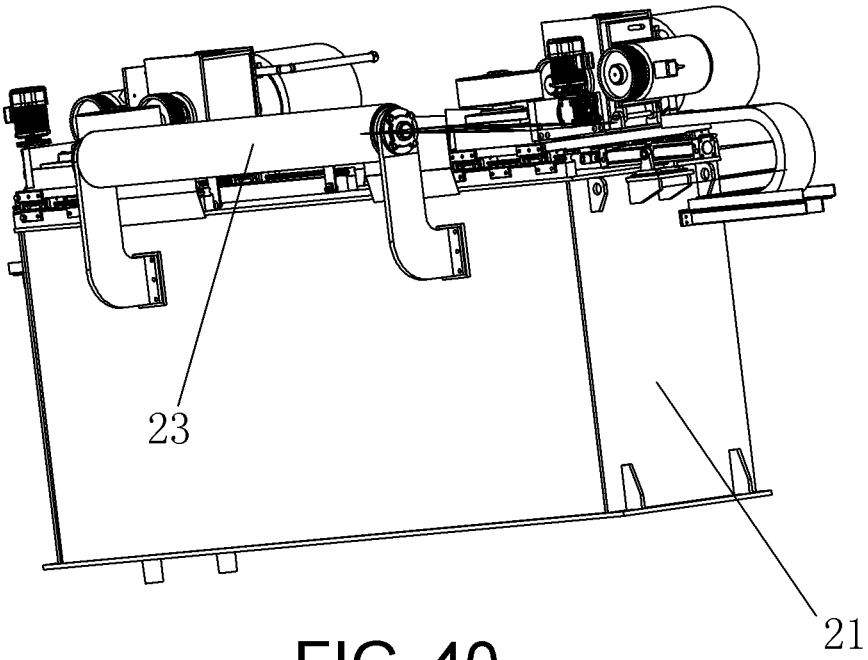
FIG. 40 is the second structural schematic view of the steel-plate side-surface descaler.
Figure 41:
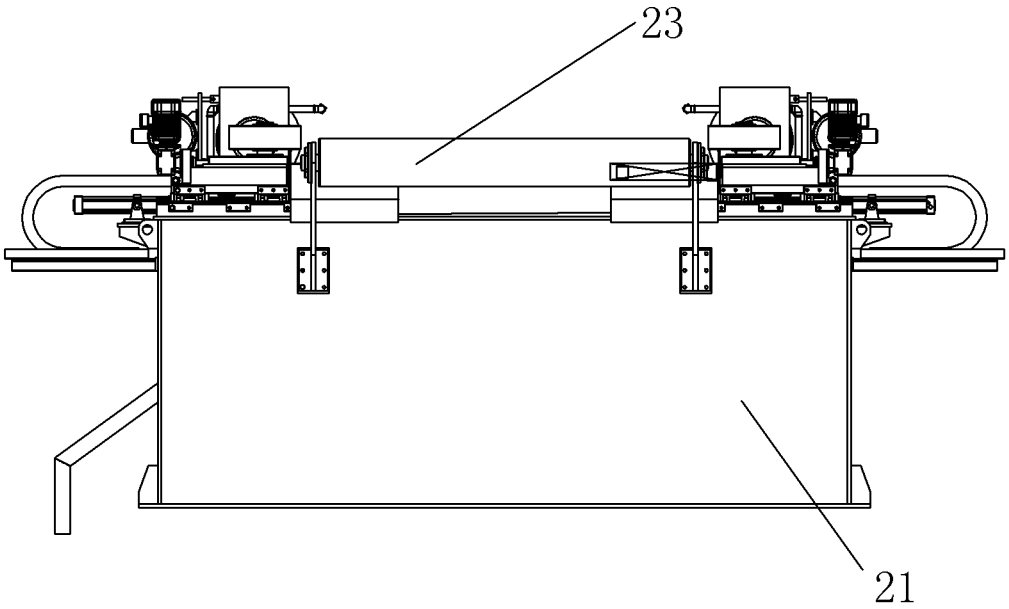
FIG. 41 is a front view of the steel-plate side-surface descaler.
Figure 42:
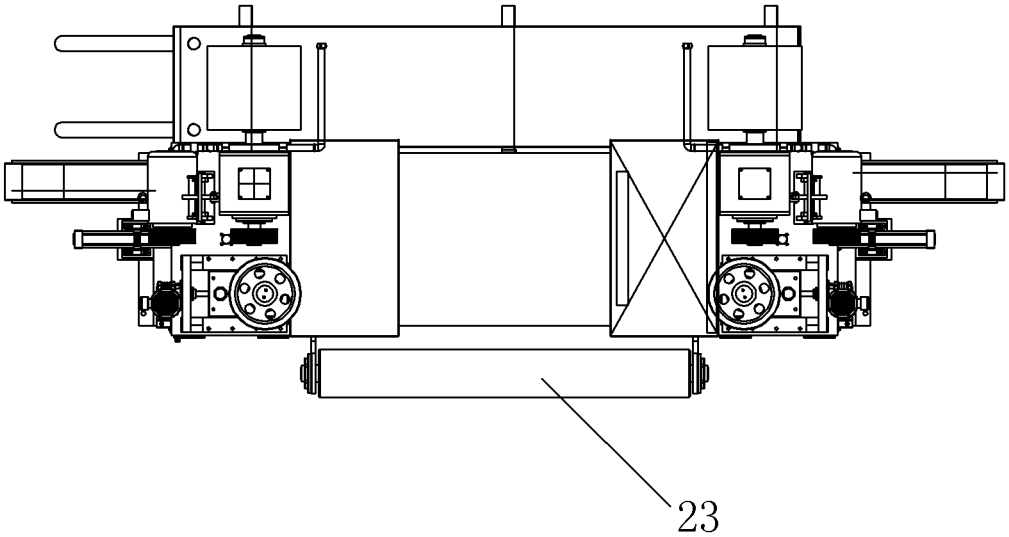
FIG. 42 is a top view of the steel-plate side-surface descaler.
Figure 43:
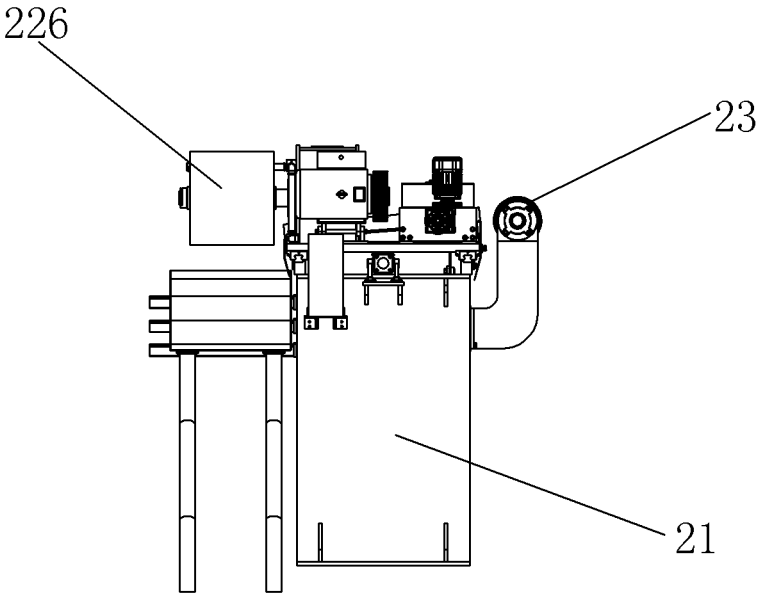
FIG. 43 is a side view of the steel-plate side-surface descaler.

The limit block 4144 is fixedly arranged on the horizontal bar 4111. There are at least two limit blocks 4144. And the two limit blocks 4144 are each close to one support mechanism 4140. As shown in FIG. 36, when the descaling roller 134 falls into the descaling-roller supporting area 4112, the limit blocks 4144 abut against the end surface of the core of the descaling roller, restricting the movement of the descaling roller in its own axial direction. In the natural state, the elastic mechanism abuts against the support blocks 4142, and the support blocks 4142 abut the side surface of the limit blocks 4144. Specifically, the front surface 4150 of the clamping block 4148 abuts the side surfaces of the limiting blocks 4144; and when the descaling roller 134 falls, the both ends of the outer surface of the descaling roller 134 fall on the support wheels 4143, and the support blocks 4142 are pressed toward the side bars 4110. At the same time, the elastic mechanism is compressed to generate a resetting elastic force. When the elastic mechanism is compressed, a buffering effect also takes effect. Of course, when the descaling roller 134 is dropped into position in one step, the support blocks 4142 may not be squeezed outward. The support mechanism 4140 not only supports the descaling roller but also protects the same from excess pressure.

The first frame 11 of the steel-plate surface descaler 1 is provided with a lifting-motor operating-position detecting switch, which may be, for example, a photoelectric switch. Both the lifting-motor operating-position detecting switch and a lifting-motor controller are connected with a control center. When the lifting motor drives the descaling roller to descend to a preset position, the lifting-motor operating-position detecting switch detects and sends a signal, such that the control center stops the lifting motor from further operation, and the descaling roller stops descending. But if the lifting-motor operating-position detecting switch fails, the descaling roller continues to descend and to cause damage.

In light of the above situation, in order to prevent the excess pressure of the descaling roller during the roller-changing operation (that is, the failure of the lifting-motor operating-position detecting switch causes the lifting motor to have excess pressure), a limit detector (a photoelectric sensor, which is not illustrated) is further installed on the support blocks 4142, and an alarm (not marked in the figures) is installed on the side bar 4110 of the moving seat. As the limit detector detects the pressing of the scale-broking roller, the support block 4142 moves for a distance facing the side bar 4110. When the support block 4142 moves to a preset limit distance, the alarm is triggered, and the control center stops the device from further operation, which protects the device effectively.

Furthermore, there is also a bearing-seat avoiding area 4113 next to the descaling-roller supporting area 4112. The bearing-seat avoiding area 4113 is located between the main shaft 416 and the descaling-roller supporting area 4112. A stopper block 4146 is fixed in the bearing-seat avoiding area 4113 where it is close to the main shaft 416, and the stopper block 4146 is also fixed on a fixed bar 4111. When one of the bearing bases on the chief operating beam 132 falls into the bearing-seat avoiding area 4113, the stopper block 4146 exactly abuts the bearing base, preventing it from moving in the axial direction and from touching the main shaft 416, whereas the other bearing base is outside the moving seat 411.

As shown in FIG. 38 to FIG. 43, the steel-plate side-surface descaler 2 includes a second frame 21 and a side-surface descaling mechanism 22. There are two side-surface descaling mechanisms 22, disposed opposite to each other at the two sides of the second frame 21. The side-surface descaling mechanism 22 includes a second linear slide rail 221, a second linear slide block 222 sliding on the second linear slide rail 221, an operating-roller seat 223 installed on the second linear slide block 222, and an roller-seat cylinder 224 for pushing the operating-roller seat 223. The roller-seat cylinder 224 constantly maintains in a state of pushing the operating-roller seat 223. The operating-roller seat 223 is equipped with a descaling-roller seat 225, and the descaling-roller seat 225 is provided with a side-brush descaling roller 226. In the operating state, the side-brush descaling roller 226 constantly maintains its contact with the side of the steel plate. A guide wheel 227 is also installed on the operating-roller seat 223. In the operating state, the guide wheel 227 constantly maintains its contact with the side of the steel plate. A guide-wheel driving mechanism 228 is further installed on the operating-roller seat 223. The guide-wheel driving mechanism 228 includes a decelerating motor 2281 and a screw 2282. The guide wheel 227 is disposed on a sliding block through a rotating shaft. The sliding block is threadedly connected with the screw 2282, and the decelerating motor 2281 drives the screw to drive the sliding block and the guide wheel 227 to move horizontally. A guide shaft 23 of the steel plate is disposed at an entrance end of the second frame 21.

The steel plate enters the steel-plate side-surface descaler through the guide shaft, and the roller-seat cylinder pushes the operating-roller seat to move inward until the descaling roller contacts the side surface of the steel plate. The guide-wheel driving mechanism drives the guide wheel to move inward to abut firmly against the steel plate. At this time, the descaling roller performs the descaling treatment on the side surface of the steel plate. When the abrasive steel plate on the surface of the descaling roller is worn off to a certain degree, causing the descaling of the side surface of the steel plate to be ineffective, the guide-wheel driving mechanism drives the guide wheel to move outward. Under the operation of the roller-seat cylinder, the operating-roller seat moves inward until the abrasive steel plate on the surface of the descaling roller again comes into close contact with the side surface of the steel plate. The outward movement of the guide wheel and the inward movement of the operating-roller seat are synchronized, and the guide wheel is kept at all times in the state of clamping both sides of the steel plate. And such automatic adjustment enables the descaling roller to perform the descaling effectively at all times.

What is claimed is:

1. A steel-plate descaling device, comprising a plurality of steel-plate surface descalers and a plurality of steel-plate side-surface descalers disposed along a device moving direction and a trolley rail disposed in parallel to one side of the device, wherein the steel-plate surface descaler and the steel-plate side-surface descalers all comprise a descaling roller for polishing a steel plate through rotation, and at least one roller-changing vehicle is disposed on the trolley rail to be slid back and forth, and the roller-changing vehicle is disposed with a roller-changing mechanism, and when the roller-changing vehicle travels to a front side of the steel-plate surface descaler, the roller-changing mechanism extends into the steel-plate surface descaler to perform a roller-changing operation, wherein the steel-plate surface descaler comprises a first frame, a roller-clamping mechanism, and a liftable descaling mechanism, wherein the liftable descaling mechanism is disposed on an upper part of the first frame for driving the engaged descaling roller to perform descaling on a surface of the steel plate, the roller-clamping mechanism is disposed on one side of the first frame below the liftable descaling mechanism and is disposed to face a traveling direction of the steel plate, restricting a vertical movement of the steel plate, the first frame comprises a base, side plates provided on left and right sides of the base, and an upper bracket opposite to the base, a U-shaped hole is provided on the side plate, the upper bracket is fixed by surrounding steel beams, and the liftable descaling mechanism is disposed at a center of the upper bracket, and roller-changing rails are disposed between the two U-shaped holes facing each other, the roller-changing rails are disposed symmetrically, and the descaling roller is disposed above the two roller-changing rails.

2. The steel-plate descaling device according to claim 1, wherein the roller-clamping mechanism is arranged on one side of the base, and the entire roller-clamping mechanism is perpendicular to a direction of the steel plate traveling on a flow line, the roller-clamping mechanism comprises two vertical beams arranged in parallel and disposed between the two side plates, and a pair of duo-rollers disposed horizontally are provided on the vertical beams, the upper duo-roller is disposed to be movable in a vertical direction and to be fixed, two duo-roller lifting-and-clamping mechanisms are disposed opposite to each other on the two vertical beams, the duo-roller lifting-and-clamping mechanism comprises a duo-roller lifting cylinder, a duo-roller shaft seat, a lifting gear, and a lifting rack, both ends of the upper duo-roller are fixed respectively in the duo-roller shaft seat, the duo-roller lifting cylinder is connected with the duo-roller shaft seat, driving the duo-roller shaft seat to move in a vertical direction, and the lifting gear is installed on an outer side of the duo-roller shaft seat, and the lifting rack is provided fixedly on the vertical beams.

3. The steel-plate descaling device according to claim 1, wherein the liftable descaling mechanism comprises an upper beam, a chief operating beam, a bearing base, and a descaling roller, wherein the chief operating beam is disposed below the upper beam, a lifting motor, an angle adjuster, a connecting shaft, and a lifting mechanism are provided on the upper beam, wherein the angle adjuster is provided at a center of the upper beam, one of the connecting shaft is provided respectively on both sides of the angle adjuster, one end of the connecting shaft is disposed on the angle adjuster, the other end of the connecting shaft is in corporation with the lifting mechanism, the lifting motor is connected with the angle adjuster, driving the connecting shaft to rotate, thereby impelling the lifting mechanism to operate, and since a lower end of the lifting mechanism is connected with the chief operating beam, the chief operating beam moves in a vertical direction as being driven by the lifting mechanism, two bearing bases are provided, which are a first bearing base and a second bearing base, wherein the two bearing bases are disposed respectively on both sides of a lower end of the chief operating beam, and both ends of the descaling roller are disposed respectively on the two bearing bases.

4. The steel-plate descaling device according to claim 3, wherein the lifting mechanism is a worm gear mechanism, wherein another end of the connecting shaft is fixed to a worm gear rotating synchronously, the worm gear meshes with a worm vertically disposed, the worm is disposed within a worm protecting sleeve, and a lower end of the worm passes through the upper beam and connects the chief operating beam.

5. The steel-plate descaling device according to claim 3, wherein a first linear slide rail is disposed in front and rear sides of the upper bracket, wherein a first linear slider is disposed on the first linear slide rail, and a lower end of the upper beam is fixed on the first linear slider, and an upper-beam driving mechanism is installed on one of left and right sides of the upper bracket, wherein the upper-beam driving mechanism is adapted to drive the upper beam to move back and forth on the first linear slide rail.

6. The steel-plate descaling device according to claim 3, wherein two groups of through holes are provided on left and right sides of the upper beam, wherein each group of the through holes comprises four through holes arranged in a rectangular shape, and each through hole is provided with a guide sleeve, and two groups of guide rods are respectively provided at both ends of the chief operating beam, wherein each group of the guide rods comprises four guide rods each located at four vertices of a rectangle, and the four guide rods on the same side respectively pass the four guide sleeves located on the same side.

7. The steel-plate descaling device according to claim 3, wherein a slide-rail supporting seat is provided at an end of the chief operating beam close to the first bearing base, wherein the slide-rail supporting seat is provided with a shaft-seat slide rail on which a movable shaft-seat slider is provided, and the first bearing base is installed on the shaft-seat slider to move back and forth on the shaft-seat slide rail through an acting of a shaft-seat driving device.

8. The steel-plate descaling device according to claim 7, wherein the shaft-seat driving device is a drive cylinder installed on a bottom surface of an end of the chief operating beam disposed with the shaft-seat slide rail, the drive cylinder is articulated with a cylinder seat installed on a bottom surface of the chief operating beam, and a hydraulic rod of the drive cylinder is connected with the first bearing base on a same side for driving the first bearing base to move back and forth on the shaft-seat slide rail.

9. The steel-plate descaling device according to claim 3, wherein an elastic auxiliary mechanism is installed to opposing sides of the first bearing base and the second bearing base, wherein the elastic auxiliary mechanism comprises a seat, the seat is rotatably installed on the first bearing base and the second bearing base, a plurality of screws are evenly installed along a circumferential direction on an end surface of the seat, the screws pass through an inner gear, the screw is sleeved with an elastic member acting on the inner gear, the elastic member is arranged between the inner gear and the seat, and the screw is further connected with an adjustment nut preventing the inner gear from disengaging, and the seat and the inner gear rotate synchronously through the screw, and a gear shaft is engaged and sleeved with the inner gear, wherein outer gears are installed to two shaft heads at both ends of the descaling roller, an exposed end of the gear shaft is provided with a chamber for the shaft heads to insert, and the exposed end of the gear shaft is retracted with respect to a front end surface of the inner gear to provide a space for the outer gear to enter.

10. The steel-plate descaling device according to claim 9, wherein gear teeth distributed in an inner circle of the inner gear along an axial direction of the inner gear comprise long teeth and short teeth, wherein the long teeth and the short teeth are arranged at intervals along a circumferential direction, and the short teeth are reduced from the front end surface of the inner gear toward the inner circle along the axial direction to provide a gap, a diameter of the outer gear is equal to a diameter of the gear shaft, the outer gear is a comb gear, wherein a number of gear teeth on the outer gear is less than a number of gear teeth on the inner gear, and the gap comprises a larger gap reserved between the two adjacent long teeth and a smaller gap formed between one of the long tooth and one of the short tooth, wherein teeth of the outer gear firstly enter the larger gap before entering the smaller gap.

11. A steel-plate descaling device, comprising a plurality of steel-plate surface descalers and a plurality of steel-plate side-surface descalers disposed along a device moving direction and a trolley rail disposed in parallel to one side of the device, wherein the steel-plate surface descaler and the steel-plate side-surface descalers all comprise a descaling roller for polishing a steel plate through rotation, and at least one roller-changing vehicle is disposed on the trolley rail to be slid back and forth, and the roller-changing vehicle is disposed with a roller-changing mechanism, and when the roller-changing vehicle travels to a front side of the steel-plate surface descaler, the roller-changing mechanism extends into the steel-plate surface descaler to perform a roller-changing operation, wherein the roller-changing vehicle comprises a base, the base is connected with a first transmission mechanism which drives the base to travel, two roller-guiding seats are disposed side by side on the base, the roller-guiding seat is connected with a roller-guiding-seat driving mechanism, the roller-guiding seat moves along a longitudinal direction of the roller-guiding seat through an acting of the roller-guiding-seat driving mechanism, a moving direction of the roller-guiding seat is perpendicular to a moving direction of the base, the roller-changing mechanism for supporting the descaling roller is disposed correspondingly on each of the roller-guiding seats, and the roller-changing mechanism moves forward or backward through an acting of a second transmission mechanism along a longitudinal direction of the roller-guiding seat.

12. The steel-plate descaling device according to claim 11, wherein a vehicle rail is disposed under the base, the first transmission mechanism adopts a sprocket transmission mechanism comprising a first motor decelerator and a rolling shaft, rolling wheels are disposed at both ends of the rolling shaft, a first sprocket is disposed on the rolling shaft, an output end of the first motor decelerator is further connected with a sprocket, and the two sprockets forms a synchronous linkage through a chain, driving the rolling wheels to roll on the vehicle rail.

13. The steel-plate descaling device according to claim 12, wherein the roller-guiding-seat driving mechanism is any one of an electric push rod, a pneumatic rod, and a hydraulic rod, one end of the roller-guiding-seat driving mechanism is installed on the base, and the other end of the roller-guiding-seat driving mechanism is connected with the roller-guiding seat.

14. The steel-plate descaling device according to claim 11, wherein the roller-guiding seat comprises a bottom plate and fencing plates extending upward along left and right sides of the bottom plate, wherein the bottom plate and the two fencing plates enclose to form a rail groove, and a roller-changing support device is located in the rail groove of the roller-guiding seat, and a traveling rail is installed at an upper end of the fencing plates along a longitudinal direction of the fencing plates, wherein the roller-changing mechanism travels along the traveling rail.

15. The steel-plate descaling device according to claim 14, wherein the roller-changing mechanism comprises a moving seat, wherein the second transmission mechanism is installed at one end of the moving seat, and the second transmission mechanism is a sprocket drive mechanism comprising a second motor decelerator and a main spindle, wherein the second motor decelerator is installed at an end portion of the moving seat, the main spindle is disposed above the moving seat through a main-spindle bearing base, both ends of the main spindle are installed with driving wheels, the driving wheels are provided to travel on the traveling rail, driven wheels traveling along the traveling rail are also installed on both sides of the other end of the moving seat, and the second motor decelerator drives the main shaft to rotate through chain transmission, thereby driving the driving wheels and the driven wheels to travel along the traveling rail.

16. The steel-plate descaling device according to claim 15, wherein a support mechanism for supporting the descaling roller is also installed on the moving seat, and the moving seat comprises side bars which are laterally symmetrical to each other and a horizontal bar arranged at intervals to connect the two side bars, the moving seat is provided with a descaling-roller supporting area, wherein the support mechanism is arranged between the two side bars, and the support mechanism is located at both ends of the descaling-roller supporting area in a longitudinal direction.

17. The steel-plate descaling device according to claim 16, wherein the support mechanism comprises a guide shaft, a support block, a support wheel, a limit block, and an elastic mechanism, wherein the guide shaft is arranged in pairs and is disposed between the two side bars, both ends of each of the guide shaft are inserted into the side bars, the support block is also arranged in pairs, and each of the support block is close to one of the side bars, the limit block is fixedly arranged on the horizontal bar, wherein one end of the support block abuts against a side surface of the limit block, the other end of the support block and the side bar abut against each other through the elastic mechanism, and the support block is sleeved and engaged with the guide shaft, and the support wheel is rotatably connected with the support block, wherein the support wheel is adapted for receiving the descaling roller.

18. The steel-plate descaling device according to claim 17, wherein the support block is U-shaped, comprising a support block body and clamping blocks located at both ends of the support block body, wherein the two clamping blocks are both located at a same side of the support block body, the support wheel is installed between the two clamping blocks, a central axis of the support wheel is parallel to the support block body, the clamping block has an upper surface and a front surface which faces the other support block, a wheel surface of the support wheel extends upward and beyond the upper surface of the clamping block in a vertical direction, the wheel surface of the support wheel extends beyond the front surface of the clamping block in a horizontal direction, and the clamping blocks at both ends of the support block body respectively pass the two guide shafts and slide along the guide shafts.

19. A steel-plate descaling device, comprising a plurality of steel-plate surface descalers and a plurality of steel-plate side-surface descalers disposed along a device moving direction and a trolley rail disposed in parallel to one side of the device, wherein the steel-plate surface descaler and the steel-plate side-surface descalers all comprise a descaling roller for polishing a steel plate through rotation, and at least one roller-changing vehicle is disposed on the trolley rail to be slid back and forth, and the roller-changing vehicle is disposed with a roller-changing mechanism, and when the roller-changing vehicle travels to a front side of the steel-plate surface descaler, the roller-changing mechanism extends into the steel-plate surface descaler to perform a roller-changing operation, wherein the steel-plate side-surface descaler comprises a second frame and two side-surface descaling mechanisms, and the two side-surface descaling mechanisms are disposed opposite to each other at both sides of the second frame, each side-surface descaling mechanism comprises a second linear slide rail, a second linear slide block sliding on the second linear slide rail, an operating-roller seat installed on the second linear slide block, and an roller-seat cylinder for pushing the operating-roller seat, wherein the roller-seat cylinder in an operating state constantly maintains to push the operating-roller seat, the operating-roller seat is installed with a guide wheel, and the guide wheel in the operating state constantly maintains to contact a side surface of the steel plate, and the operating-roller seat is installed with a descaling-roller seat, wherein the descaling-roller seat is installed with a side-brush descaling roller which in the operating state constantly maintains to contact the side surface of the steel plate.

* * * * *